United States Patent [19]

Baur et al.

[11] Patent Number: 5,046,968

[45] Date of Patent: Sep. 10, 1991

[54] ELECTRICAL CONNECTOR CONTACT HAVING AN ELECTRICAL COMPONENT DISPOSED IN A CENTRAL INTERNAL CAVITY

[75] Inventors: Robert Baur, Los Angeles; Neal Castleman, Malibu; Haw-Chan Tan, Culver City, all of Calif.

[73] Assignee: Tri-Star Incorporated, El Segundo, Calif.

[21] Appl. No.: 413,988

[22] Filed: Sep. 28, 1989

[51] Int. Cl.[5] ..... H01R 13/66

[52] U.S. Cl. ..... 439/620; 333/183

[58] Field of Search ..... 333/183; 439/620

[56] References Cited

U.S. PATENT DOCUMENTS

| | | | |
|---|---|---|---|
| 4,582,385 | 4/1986 | Couper et al. | 439/620 X |
| 4,768,977 | 9/1988 | Gliha et al. | 439/620 |
| 4,846,732 | 7/1989 | Meelhuysen | 439/620 |

*Primary Examiner*—Eugene F. Desmond

*Attorney, Agent, or Firm*—Ashen, Martin, Seldon, Lippman & Scillieri

[57] ABSTRACT

The invention facilitates individual selection and even field replacement of individual component-carrying contacts in a multicontact electrical connector. On a modular circuit-by-circuit basis, each circuit can be individually guarded against overvoltages, undesired frequencies, etc.; and in event of damage to a protection component, the protection can be easily renewed for any individual circuit in just a few minutes. An overvoltage-bypassing diode or other electrical component is positioned within a central cavity that extends axially within the body of a cylindrical contact—i.e., either a male pin or female receptacle. The component is oriented axially in the cavity. Because the bypassing component is physically protected within the cavity, it is much less vulnerable to physical and electrical damage in installation and service than in prior component-carrying contacts. One lead of the component connects electrically to the contact itself internally; another lead passes through an aperture in the contact and connects electrically with a grounding surface that is part of the outside of the contact. An electrical signal path is formed along the contact body, continuing in an interconnection structure.

49 Claims, 13 Drawing Sheets

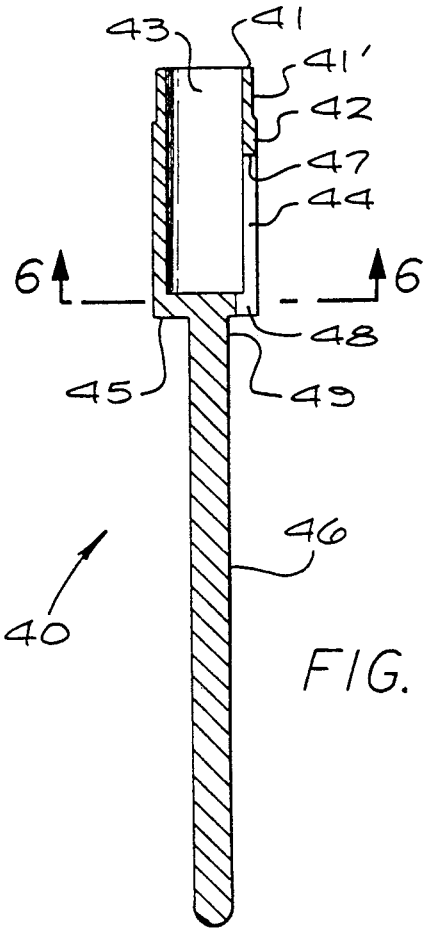
FIG. 5
FIG. 6
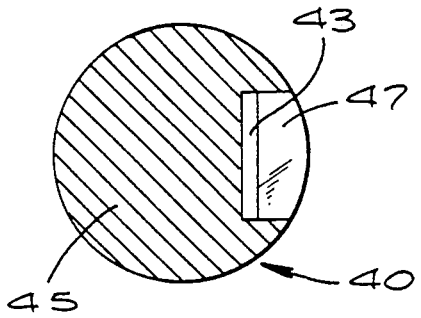
FIG. 8
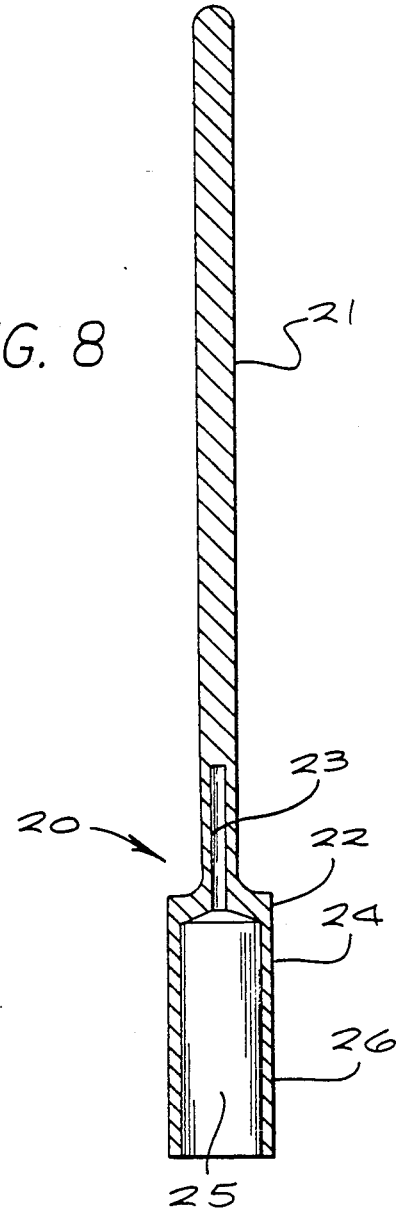
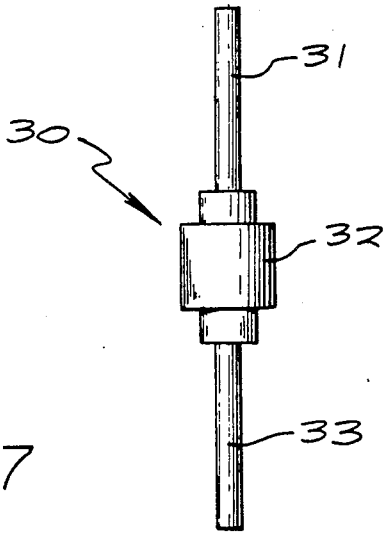
FIG. 7

ELECTRICAL CONNECTOR CONTACT HAVING AN ELECTRICAL COMPONENT DISPOSED IN A CENTRAL INTERNAL CAVITY

BACKGROUND

1. Field of the Invention

This invention relates generally to an individual contact for a multicircuit electrical connector; and more particularly to such a contact that has an associated electrical component for bypassing undesired frequencies or overvoltages to ground.

2. Prior Art

The first association of electrical components with individual contacts inside a multicircuit connector was achieved by placing the components axially in line with the contacts. Pulse absorbers and radio-frequency filters were among the components so installed.

Subsequently U.S. Pat. No. 3,790,858 to Brancaleone and Oliver showed that electrical components could instead be placed adjacent to the contacts. The components were electrically connected between the respective individual contacts and a common grounding plate spanning the interior of the shell; a parallel insulating plate with printed-circuit connections served to complete the individual contact-to-component connections.

That configuration permitted shorter connectors, while maintaining reasonable connector diameter and minimizing lead inductances. Completing the multiple interconnections to the parallel plate, however, was essentially a one-time factory operation; the Brancaleone connector once assembled was not readily serviced—particularly in the field.

Such a connector configuration has two major limitations. First, the failure rate of such a connector is in effect the aggregate of the failure rates for all the individual electrical components. Even at the factory, replacement of an individual component is at best awkward and relatively expensive.

Second, electrical damage to an individual electrical component when in use creates very nearly the same service gridlock seen commonly with other preassembled printed-circuit boards: the entire board—or here the entire connector—must be returned for repair. Attempts to correct such problems in the field require extraordinary manual dexterity and specialized experience.

Even if these resources are available, such attempts usually are severely uneconomic. As a consequence, entire equipments may be taken out of service for failure of a single commonplace element worth just pennies.

More modern efforts are typified by U.S. Pat. Nos. 4,600,262 to Nieman et al., 4,582,385 to Couper et al., and 4,572,600 also to Nieman. These inventors sought to make the individual contacts individually replaceable with ease, in the field as well as at the factory.

These three patents teach mounting of diode chips in lateral notches cut into the sides of the individual contacts. Each diode chip thus rides on its respective contact, and can be inserted into the connector and withdrawn from it on a modular basis.

One side of each chip is electrically connected with its contact at the mounting point. In all three of these just-mentioned patents, the other side of each diode chip is grounded to a spring-loaded grounding element during insertion of the contact axially into the grounding plate.

More specifically, in the first two of these three patents, the second side of each chip is left exposed in its notch and engages a spring-loaded grounding tang in the ground plate directly. In the third patent, the second side of each chip is instead permanently connected to a metallic grounding strip that extends axially along the outside of the contact to a circumferential grounding band, which in turn engages a pair of grounding springs in the grounding plate.

Unfortunately these notch-mounted-chip configurations have proven troublesome. In all three forms, the diode chips are subject to failure from mechanical shock during assembly of the contacts into the connector—and also from mechanical and thermal shock later, from humidity and chemical fumes in the operating environment, and probably from other unknown causes.

The resulting connector assemblies are thus much too sensitive for reliable, practical use. Moreover, the connector contacts often are at critical points in the associated circuitry, so that these failures cause serious problems in operation of the overall apparatus to which the connector attaches.

SUMMARY OF THE DISCLOSURE

The present invention in one form is a contact for an electrical connector. By a "contact" we mean to encompass either a male-pin contact or a female-receptacle contact for receiving a male contact pin.

The contact of our invention includes a generally cylindrical body, and a generally central cavity defined within and extending axially within the body.

The invention also includes, at one axial end (at least) of the cavity, a contact structure that is integral with or secured to the body. By a "contact structure" we mean the portion of a contact that actually performs the function of engaging a mating contact (at one end of the contact of our invention) or wires in a cable (at the other end of the contact of our invention).

Our invention further includes an electrical signal path formed along the body and continuing in the contact structure. It includes as well an electrical ground path formed at the outside of the contact.

It also includes an electrical component disposed within the cavity and having a pair of electrical leads. By an "electrical component" we mean to encompass a great number of component types—such as, purely by way of example, an overvoltage-bypassing component such as a diode, or a capacitor or resistor chip, or a metal-oxide varistor ("MOV"), or a frequency-selective component such as a filter; however, our invention is not limited to these particular examples.

The invention also includes some means for electrically connecting a first one of the leads to the ground path. For purposes of generality and breadth in expression of our invention, we shall refer to these means as the "first connecting means," or where clear in context simply the "first means."

In addition the invention also includes means for electrically connecting a second one of the leads to the signal path. Again for generality we shall call these means the "second connecting means" or "second means".

As will now be understood, the electrical component is far more effectively protected within the cavity of our invention than it could possibly be in any prior configuration. The cavity can be almost entirely unbreached by apertures, so that the component within can be shielded very effectively against mechanical stresses and shocks during installation and later, against thermal shock, against large voltage transients on neighboring contacts or other circuitry, and in particular against hostile chemical environments.

This configuration also is amenable to use of glass-encapsulated components, such as solid-glass metallurgically bonded diodes. The second barrier provided by the glass makes the components virtually immune to chemical-attack problems.

The foregoing description may be a description of our invention in its broadest or most general form. As will be appreciated, however, for maximum enjoyment of the benefits of our invention we prefer to practice the invention with several additional specific features and characteristics.

In one form of the invention, for example, we prefer that the body comprise a segment that is axially displaced from the cavity; and that the electrical ground path be formed at the outside of the axially displaced segment. We also prefer that the first connecting means comprise an axially extending conductive element interconnecting the first one of the leads with the ground path.

In this form of our invention, the axially extending element advantageously projects axially through the body. We consider it particularly desirable that the axially extending element pass through a slot formed in the body at a point adjacent to the axially displaced segment.

Preferably the axially extending element is integral with the grounding path, and inside the body connects with the first one of the leads. Still with respect to the same form of our invention, the ground path is preferably formed as a grounding band substantially encircling the axially displaced segment; and the axially extending element is an extension of the grounding band.

The band can then be a formed sheet-metal spring, with a long tang serving as the axially extending element. Preferably the first connecting means comprise an integral extension of the grounding spring, that projects axially through the slot formed in the body, and inside the body connects with the first one of the leads. The first connecting means preferably further include a solder joint within the cavity, employing a solder preform that is easily and reliably moved into position along a lead of the electronic component to complete the electrical connection.

Many other desirable features of this first form of our invention are described in a later section of this document.

In a second preferred form of our invention, the body is formed of insulating material. This insulating body can be a molded plastic part, and if desired one end of the body can be formed with threads to facilitate installation into a grounding cross-structure of the connector. (Types of cross-structures will be discussed shortly.)

In this form of the invention, the ground path preferably comprises first conductive material disposed along the insulating material and electrically interconnected with the first one of the leads by the first connecting means. The electrical signal path preferably comprises second conductive material disposed along the insulating material and electrically interconnected with the contact structure, and also electrically interconnected with the second one of the leads by the second connecting means.

Advantageously in this second form of the invention the first and second conductive materials are coated on the insulating material. The first conductive material can be coated onto an outer surface of the body; and the second conductive material onto an inner surface of the body, within the cavity.

This form of our invention thus offers the interesting advantage that most of the signal path along the contact is guarded by the grounding outer layer of conductive material, tending to suppress crosstalk within the connector as well as susceptibility to other interference sources.

In yet a third preferred form of our invention, a generally radial orifice is defined through the body to communicate with the cavity. The first one of the leads extends generally radially from the cavity through the orifice and is there electrically connected to the ground path.

Advantageously in this third form of our invention the body comprises an integral substantially cylindrical wall, encircling and substantially coaxial with the cavity, and enclosing the electrical component. An orifice is preferably defined through this wall; the first one of the leads extends generally radially from the cavity and through the wall, and is there electrically connected to the ground path.

In addition to all the forms of our invention that are introduced above, our invention has another embodiment—namely, an electrical connector. This embodiment of our invention includes a generally circumferential shell, and a structural wall of electrically conductive material spanning the shell.

Also included is a plurality of electrical-signal-conducting contacts disposed at least partly within the shell. Each contact has two ends and comprises a generally cylindrical body for conducting electrical signals from one end of the contact to another end of the contact. A grounding path is established on the outside of the body for electrical interconnection with the wall.

Carried by each one of at least some of the contacts is a diode or other electrical component for bypassing selected electrical voltages to ground. Apertures are formed in the wall for releasably receiving the contacts individually, and for making a grounding connection to the grounding path of each contact that carries a bypassing component.

This embodiment of the invention further comprises some means for securing each contact in a respective one of the apertures. These means are releasable so that a contact that has been secured in the connector can later be removed. Again for generality we shall call these means the "releasable securing means" or the "releasable means."

The releasable securing means are fully operable to release each contact and to secure a replacement contact even after the connector is fully assembled and has been in service.

While the foregoing may describe the broadest form of this embodiment of our invention, certain additional features or characteristics are advantageously incorporated to enhance performance. In particular, each of the contacts that carries a bypassing component preferably has a generally coaxial central cavity, defined within and extending axially within the signal-conducting body, for receiving and enclosing the bypassing component.

Preferably each of the bodies that carries a bypassing component substantially fully encloses that component. In one group of forms of this embodiment, the releasable means advantageously comprise male threads formed in the exterior surface of each contact, and mating female threads formed within each of the apertures in the wall. In these forms, each contact is threadable into or out of its respective aperture individually.

It is desirable that the female threads in all of the apertures by substantially identical; and that all of the contacts be mechanically interchangeable. In this way each contact is made threadable into or out of any of the apertures in the wall.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 also represents a multicontact connector that is another preferred embodiment of our invention.

FIG. 5 is a longitudinal section of one half—which in this document will be called the "forward end"—of the body of the FIG. 1 contact, together with an integral contact structure.

FIG. 6 is an enlarged cross-sectional view, taken along the line 6—6 in FIG. 5, of the forward end of the contact body.

FIG. 7 is an exterior view of a diode that is incorporated into the FIG. 1 contact.

FIG. 8 is a longitudinal section of another half—which in this document will be called the "rearward end"—of the body of the FIG. 1 contact, together with an integral contact structure.

More specifically, FIG. 13 shows the forward half of the contact body, preassembled with filter components. FIG. 14 shows the rear half of the contact body added to the FIG. 13 subassembly, and FIG. 15 shows an insulating sleeve added to the FIG. 14 elements.

FIGS. 17 and 18 show the forward half of the contact body: FIG. 18 is an external view of the portion of the half-body that carries the diode; and FIG. 17 show the entire half-body, but partially in longitudinal section, taken along the line 17—17 in FIG. 18.

FIG. 19 is an exterior view of the diode, together in a subassembly with insulating sleeves.

FIG. 20 is a longitudinal section of the rearward half of the contact body.

FIG. 21 shows the grounding spring after it has been stamped or diecut but while it is still flat.

FIG. 22 shows the spring after it is rolled and bent into its final shape.

More specifically, FIG. 24 shows the diode with its insulating sleeve; FIGS. 24 and 25 show the two halves of the contact body; and FIG. 27 shows a stamped solder preform for holding the two halves of the body together.

FIG. 28 shows the diode installed in one of the connector halves and the other connector half ready to be added; and FIG. 29 shows the completed assembly.

DETAILED DESCRIPTION OF THE PREFERRED EMBODIMENTS

Broadly speaking the present invention has two embodiments: a contact for use in a connector, and a connector having multiple contacts. The first of these embodiments—the contact—in turn has three preferred forms.

These embodiments and forms have been introduced above, and will now be presented in greater detail. As will be seen, these embodiments and forms have numerous variants that can be employed as suits the particular application at hand, all within the scope of the appended claims.

Figure 2:
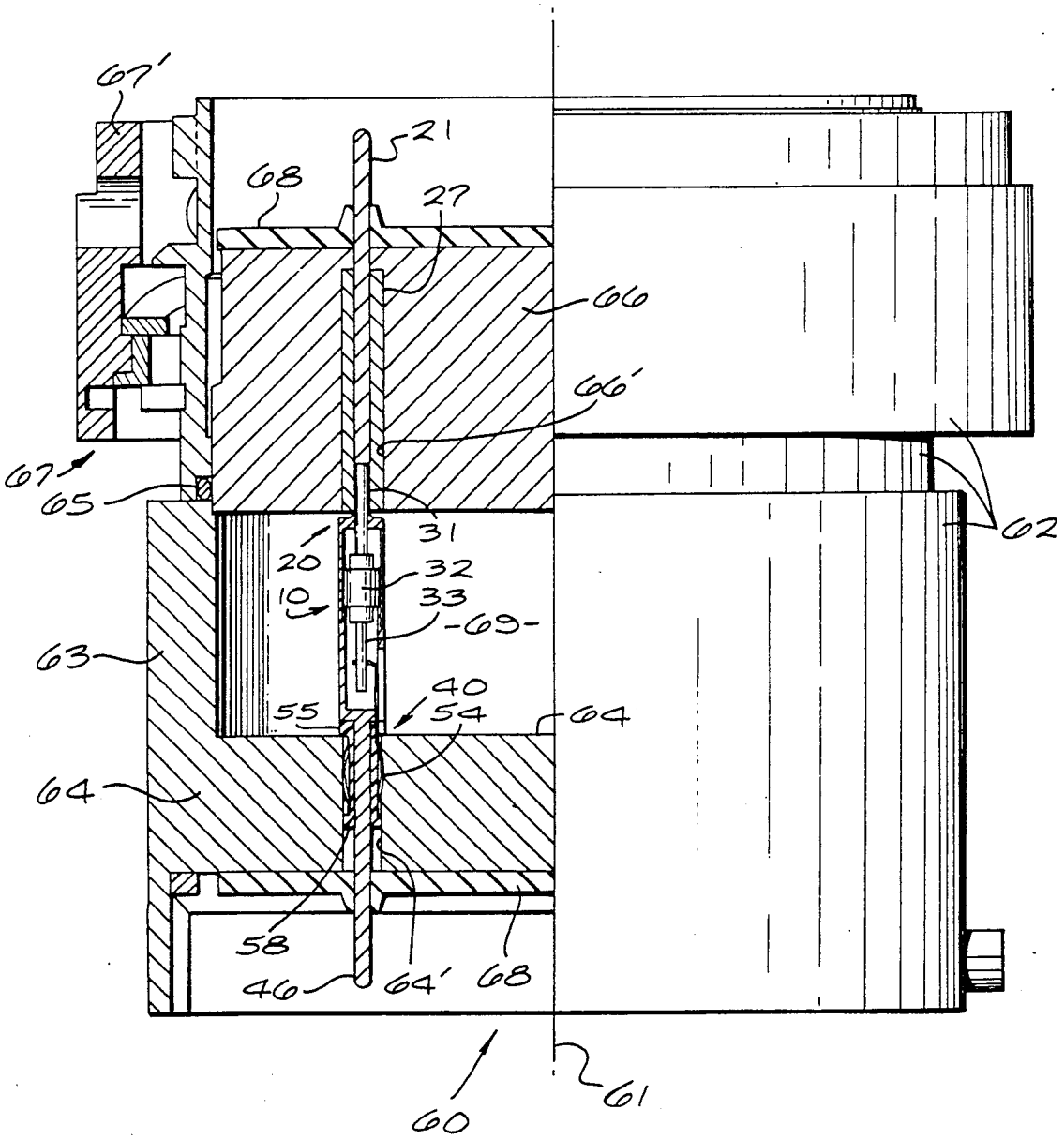
FIG. 2 is a like section of the FIG. 1 diode contact installed in a representative position in a connector which typically has a multiplicity of such contacts installed. As will be explained more fully below, this drawing is partially schematic.

FIGS. 1 through 9 show the first embodiment of the invention, the contact, in its first preferred form. FIG. 2 shows this first preferred form installed in a connector, and as noted above also represents the second embodiment, the connector.

In this form the contact 10 has five parts. One part is an integral half-body and contact structure 20. Again, by "contact structure" we here mean a structure that actually performs the function of engaging a mating contact element. Such a contact structure can be either male, as in all the drawings in this document, or female; this will be readily understood by those skilled in the art of modern electrical contacts and connectors.

This first part 20 includes an elongated slender contact structure 21 terminating in a broader transverse bulkhead or wall 22. (For female contact structures 21, the diameter will be greater along at least part of the structure nearer the tip, and an orifice will be formed at the tip.) A longitudinal bore 23 is formed through the wall 22, extending a short distance into the contact structure 21.

Depending from the periphery of the wall is a cylindrical shell 24 that defines a cavity 25, open at the end, and that terminates in a skirt 26.

A second part of this form of the contact is a diode or other electrical component 30. For simplicity and definiteness we will after this call the electrical component simply a "diode."

The diode 30 has a first lead 31, which perhaps most typically will be its positive lead. If, however, the signal to be carried on the contact 10 is negative (as in the case of many digital circuits), or particularly if overvoltages most likely to arise on the contact 10 are negative, then the first lead 31 may instead be the negative lead of the diode.

This lead 31 attaches to a body 32 of the diode 30, which incorporates the semiconductor junction that performs the diode function. As is well known, such junctions characteristically operate with a threshold voltage; and this threshold is advantageously used to discriminate between voltage levels that can be handled by the associated circuitry, and overvoltage levels that are likely to damage or interfere with that circuitry. The diode bypasses the latter overvoltages to ground, while standing off the former.

The diode 30 also has a second lead 33, which receives the overvoltage (or, depending on the junction behavior, at least the portion exceeding the threshold) from the junction and passes it to ground. In our invention the diode body 32 and adjacent portions of the leads can be encapsulated or potted—as, for example, by very thin layers of glass—to protect the junction against contaminants in the working environment.

Procedures are now commercially available for applying glass encapsulation in a layer as thin as twenty Angstroms. Such procedures are suitable for incorporation into the several embodiments and forms of our invention.

The tip of the first lead 31, and all or part of the body 32, of the diode 30 are inserted into the cavity 25 of the first half-body and contact structure 20. The tip of the lead 31 is further inserted into the bore 23, formed through the wall 22, and into the contact structure 21.

The first lead 31 is preferably soldered to the bore 23. The second lead 33, as well as possibly part of the body 32, of the diode protrudes from the open end of the cavity 25 at the skirt 26.

A third part of the contact 10 is another integral half-body and contact structure 40. This part includes a skirt 41 surrounding the open end of a cavity 43, which cavity is defined within a generally cylindrical shell 42. The outer surface of this skirt 41 is turned down or otherwise formed with reduced diameter 41' to match the inside diameter of the cavity 25 in the first half-body and contact structure 20, described above.

The skirt 41 of this third part 40 accordingly can be received within the skirt 26 of the above-described first part 20, while the outside diameters of the two shells otherwise match—forming a casing 24, 42 with an external surface of generally uniform diameter along its length.

The wall 42 and cavity 43 of the second half-body and contact structure 40 terminate in a transverse bulkhead or end wall 45, from the opposite side of which extends a slender contact structure 46. The two half-bodies 20 and 40 thus when fitted together form an enclosure for the diode 30.

The second half-body and contact structure 40 has a longitudinal slot 44, which passes entirely through the cylindrical shell 42 at one side. The slot also has a section 48 that passes entirely through the end wall 45, within the inside diameter of the shell 42.

As best shown in FIG. 6, this construction provides a thin longitudinal pathway through the end wall 45 and into the cavity 43. At its end nearer the skirt 41, the slot 44, 48 terminates in an end surface 47 that is formed in the shell 42. The contact structure 46 is encircled by a very small sharp ridge 49 (see FIG. 9) for gripping purposes, as will be seen shortly.

The remaining two parts of the contact form a subassembly 50. More specifically, the fourth part is an integral grounding ring and tang 51–54, and the fifth is an insulating sleeve 55–59 that fits around the second contact structure 46, which was just discussed.

Figure 1:
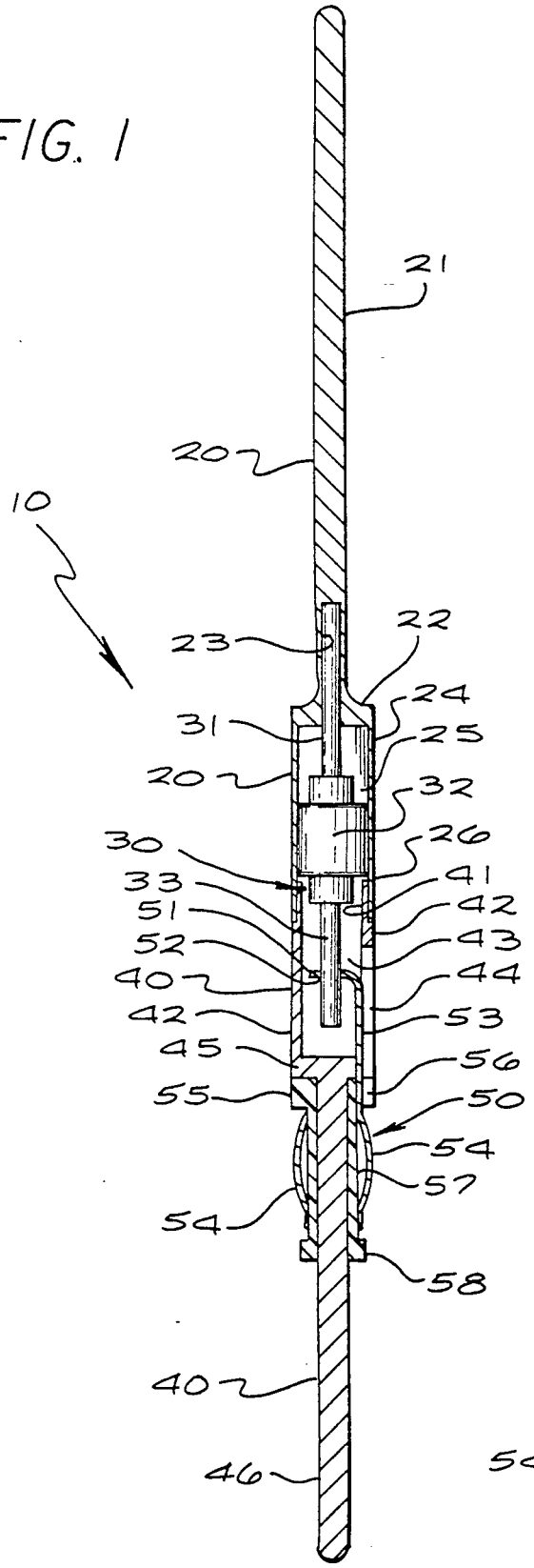
FIG. 1 is a longitudinal section of a diode contact, configured in accordance with a first preferred form of our invention. Included in this drawing is a diode which is not drawn in section.
Figure 3:
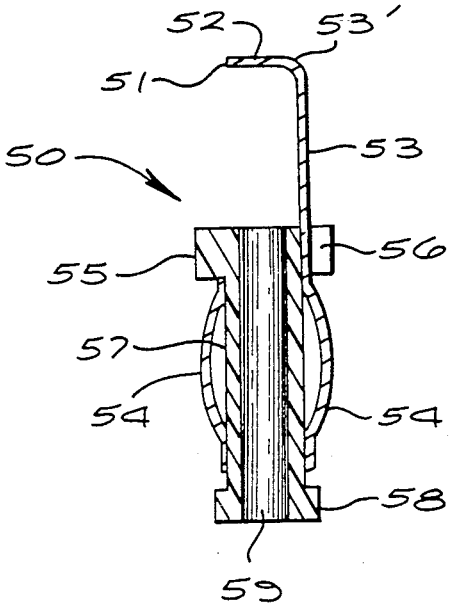
FIG. 3 is a like section of a molded insulating sleeve and a formed grounding band which together constitute a subassembly of the FIG. 1 contact.
Figure 4:
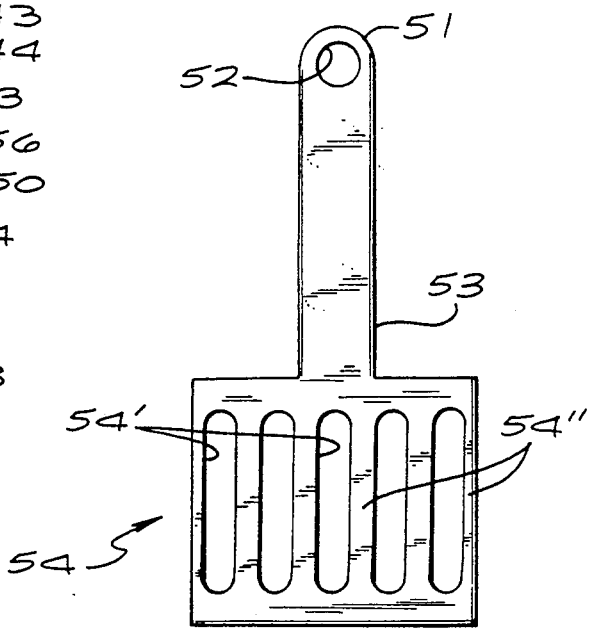
FIG. 4 is a plan view, greatly enlarged, of the FIGS. 1 and 3 grounding band as it is stamped or diecut and before it is formed into the shape shown in FIGS. 1 and 3.

The grounding ring and tang are stamped as a single piece of this sheet metal. As best seen in FIG. 4, this component has a semicircular tip 51, a concentric orifice 52 in the tip, and a slender tang 53 extending from the tip 51. At the other end of the tang 53 is a rectangular barrel-spring section 54, pierced by several longitudinal slots 54' to leave longitudinal grid members 54''.

Figure 22:
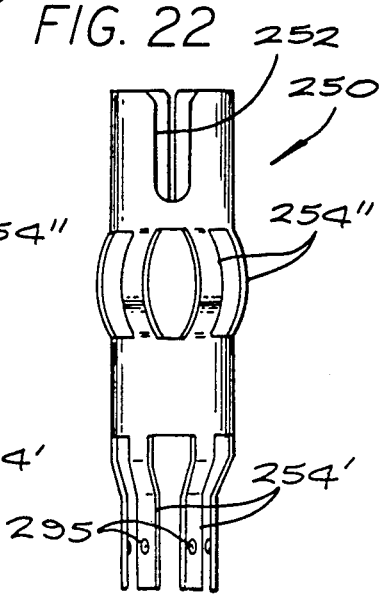

The barrel-spring grid members 54'' are first curved about a transverse axis, to bulge out of the plane of the stamped sheet. Then the entire rectangular portion of the component is rolled about a longitudinal axis to form a very generally cylindrical but outwardly bulging spring. (This barrel-shaped part of the construction is broadly similar to that shown in the central portion of FIG. 22, for another form of the contact.)

The tang 53 is inserted into a very fine insulating sheath (not shown) to guard it from contact with the circular and transverse walls 42, 45. The perforated tip 51 is then bent inward at 53' (FIG. 3) to a right angle from the rest of the tang 53—so that the orifice 52 in the tip 51 of the tang is at the axis of the barrel shape 54.

The insulating sleeve 55–59 is generally cylindrical, with a relatively large flange 55 at one end. This flange is transected by a notch 56, and continues in a thin-walled concentric body 57.

At the remote end of the body 57 is another concentric flange 58, smaller than the first. A cylindrical central bore 59 passes through both flanges 55, 58 and the intermediate body 57. Fitted around this sleeve, between the two flanges, is the barrel spring 54; and its tang 53 passes through the notch 56 in the larger flange. Now the orifice 52 is generally at the axis of the bore 59 in the sleeve.

This subassembly 50 is mounted on the second contact structure 46 of the second half-body and contact structure 40—the tang being temporarily bent outward to permit assembly—with the larger flange 55 butted against the outside of the transverse wall 45. The fine ridge 49 encircling the second contact structure 46 grips the interior surface of the sleeve.

The notch 56 in the flange 55 is angularly aligned with the slot 44, 48 in the half-body, and the tang 53 fits within and along the slot. The tip 51 of the tang 53 extends transversely into the cavity 43, and the orifice 52 in the tip 51 is at the center of the cavity 43.

At assembly of the two half-bodies 20, 40—which in principle can be performed either before or after the sleeve-and-spring subassembly 50 is positioned on the second half-body 40—the grounding lead 33 of the diode 30 is inserted through the orifice 52 in the tip 51 of the spring-and-tang structure 51–54, and finally the lead 33 and tip 51 are soldered together as will be described below.

The two half-bodies 20, 40 are also soldered or welded together, at their junction where the sleeve 26 mates with the smaller-diameter portion 41' of the skirt 41. The individual contact 10 is then complete as in FIG. 1, and as mentioned earlier may be provided with any of a great number of different diode characteristics.

Furthermore, each contact may be provided with any one of an even greater variety of different combinations of diodes with other filter elements that will be discussed shortly. In this way each contact 10 is made up to be electrically customized for suitability with a particular respective kind of circuit, though mechanically interchangeable with many other contacts.

The grounding spring 54 may be used to bypass overvoltages through the diode to any suitably configured transverse grounding-plate structure, or "ground plane" as such plates are sometimes called. We prefer, however, to use our novel contact in conjunction with a connector configuration in which the transverse grounding structure is an integral structural element of the connector body—as illustrated in FIG. 2.

In that drawing an exemplary contact 10 represents one of typically many (sometimes over a hundred) contacts installed in a single connector 60. The connector is drawn cut away along the centerline 61, to show generally the exterior surfaces 62 at the right side of the drawing, and interior elements in longitudinal section at the left.

The connector includes a cylindrical wall or shell 63 and integral bulkhead 64. Each connector 10 is received in a respective bore 64' formed in the bulkhead 64, with the grounding spring 54 engaging the interior of the bore 64'.

This portion of FIG. 2 (as well as FIG. 9) is schematic in that, for purposes of simplicity and clarity in illustration, the spring 54 is shown uncompressed and accordingly appears to be embedded in or interfering with the solid bulkhead 64. As will be appreciated, in actuality the spring deflects resiliently into a more complicated, flattened shape that conforms to the bore 64'. In this process, the spring is constrained between the two insulating-sleeve flanges 55, 58 against excessive longitudinal extension.

Such constraint in turn prevents excessive inward deflection of the spring. Overdeflection of the spring could otherwise impair the effectiveness of the electrical-connection function—particularly if the contact is removed and reinstalled several times.

A retainer ring 65 secures to the connector shell 63 a rearward section 67, which includes a conductive cylindrical block 66 that spans the interior of the rearward section 67, an external coupling ring 67' for engaging mating connectors, and other generally conventional features which will be understood by those skilled in the art. The conductive block 66, which may be a conductive elastomer, has a respective bore 66' (aligned with a corresponding bore 64' in the bulkhead 64) to receive the rearward portion of each contact 10.

More specifically, the first contact structure 21 passes through the conductive block 66. When desired, a generally conventional cylindrical filter element 27 can be threaded onto the first contact structure 21 and fitted into the bore 66' in the rearward conductive block 66. The bore 66' may be necked down at its rearward end as shown, to retain the filter element 27 while passing the first contact structure 21.

Generally identical or mirror-image environmental seals 68 are fitted over the protruding first and second contact structures 21, 46 at the rearward and forward ends of the connector 60 respectively. These seals are perforated elastomeric discs that protect the diodes and functioning electrical-interconnection surfaces (e.g., the engagement of each spring 54 with its bore 64') against intrusion of fumes or liquids from the operating environment.

Defined within the shell 63, and between the bulkhead 64 and rearward block 66, is a generally cylindrical cavity 69 that is spanned by each diode 10. In assembly of the connector, each diode 10 can be preinstalled in the bulkhead 64. The cavity 69 provides a partially protected but accessible working space for these manipulations.

Similarly each filter 27 can be preinstalled in the rearward block 66. Then that block 66, with the rest of the rearward section 67, can be brought up from the rear, and the tip of each first contact structure 21 started into its respective bore 66' (and into filter 27 if present). The rearward block 66 and section 67 slide into place, closing off the cavity 69 and firmly positioning each contact 10, and are secured with the retainer 65.

The connector shown in FIG. 2 is an example of a type known as a "diode adapter"—a freestanding intermediate connecting structure that can be placed between two other connectors, to supply desired overvoltage bypassing or filtering. Although the illustrated connector has male contacts at both ends, as mentioned earlier the contacts at either or even both ends can be female.

Hence, for example, the adapter could be made to fit between a preexisting chassis-mounted connector with female contacts and a preexisting cable-terminating connector with male contacts—thereby upgrading the circuit-protection system without either modifying the components in the chassis or rewiring the cable termination.

On the other hand, our invention is by no means limited to manufacture in the form of an adapter. Rather, it is entirely amenable to use in chassis-mounted connectors and in cable-terminating connectors.

For such purposes, in principle the contact structure at either end of the connector (that is to say, either the first contact structure 21 or the second contact structure 46) can be configured as an individual wire termination. For direct types of cable terminations, however, it may be found preferable to use the rearward or first contact structure 21, because the spring-located forward or second contact structure 46 may be adversely affected by repeated lateral flexing or twisting of the cable.

Connection of a contact structure to an individual wire can be completed by soldering, crimping, interference fit, or various other known or new methods.

Figure 9:
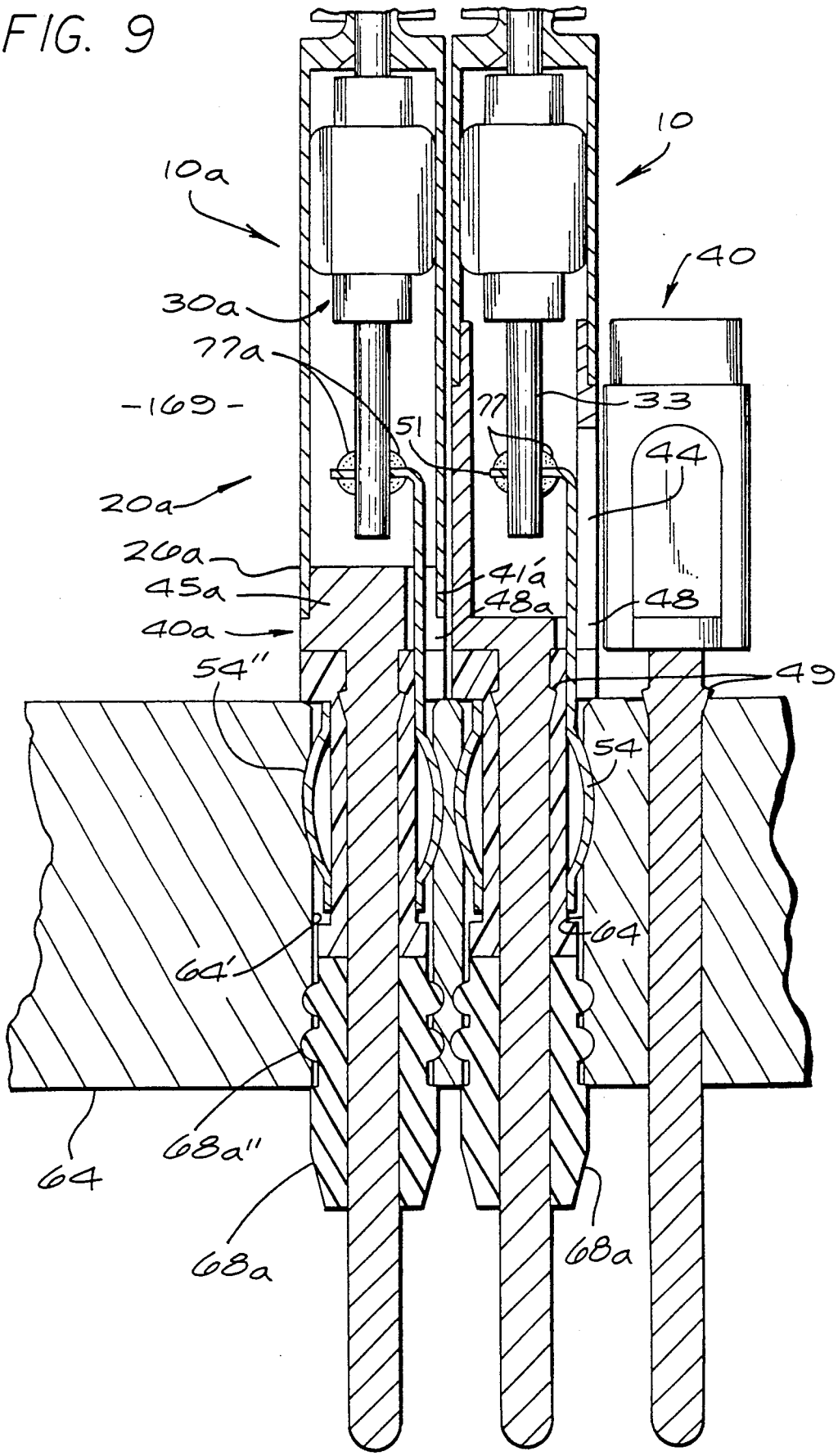
FIG. 9 is a partially schematic longitudinal section of part of a multicontact connector generally similar to that of FIG. 2, but showing alternatives or variants for certain details of the construction.

Within each contact 10, as illustrated in FIG. 9, the electrical connection between the grounding spring and tang 51–54 and the diode grounding lead 33 is effected by solder 77. For this purpose we prefer to use a solder paste—picking up a small quantity of that material on the tang tip 51, and particularly at the orifice 52 in the tip.

When the tip 51 is then pushed onto the diode lead 33, the solder paste tends to concentrate at the mechanical junction between the tip and the lead, and upon melting forms an excellent joint there. A small amount of trial and error may be required to optimize the viscosity of the paste.

Alternatively the solder can be provided as a solid solder preform that is slid onto the tip of the diode lead 33, and then pushed further into place by the tang tip 51 during assembly of the two halves of the contact. This approach naturally seems more appealing because preforms are stable, potentially quite uniform, and neater.

We have found, however, the use of a solder preform to be more awkward at the stage of assembling the two halves of the contact, because the preform tends to be bulkier than a small globule of solder paste. A preform is also more subject to failure at the stage of melting the solder to form the joint, because the preform sometimes is pushed too far onto the lead and does not melt precisely into the mechanical junction.

FIG. 9 also affords another view of the second half-body and contact structure 40. This view appears at the right side of the drawing, and is taken with the element rotated ninety degrees (clockwise as seen from above) from its orientation that is illustrated at the center of the drawing.

In addition, FIG. 9 shows two variants in details of the contact geometry and in details of environmental sealing. In particular, in the variant contact 10*a* that is drawn at the left side of FIG. 9, the first half-body 20*a* has a considerably longer cylindrical shell and skirt 26*a*—while the second half-body 40*a* terminates at the transverse wall 45*a* and has no skirt or cylindrical shell at all.

Thus the skirt 26*a* of the first half-body 20*a* extends all the way to the transverse wall 45*a* of the second half-body 40*a*, and engages that transverse wall directly. With such a configuration, in principle no transverse slot is required in the cylindrical shell of the contact body.

In the previously described form 10 of the contact, the primary function of the slot 44, 48 is to permit access of the tang tip 51 to the interior of the cavity; but in the variant form 10*a* as seen at the left of FIG. 9 such access is readily obtained with only the longitudinal slot 48*a* through the transverse wall 45*a*. This difference arises because the cylindrical shell and skirt 26*a* are not present until after the tang has been moved into position.

In practice, however, we have found that this variant configuration has two major drawbacks. First, the mechanical junction between the two half-bodies 20*a*, 40*a* occurs at a point where one of the structures—the transverse wall 45*a* of the forward half-body 40*a*—is slotted.

Consequently the skirt 26*a* of the rearward half-body 20*a* is unsupported along part of its circumference, making the engagement between the two structures significantly weaker. In particular the compound structure is more subject to collapse or bending from transverse force at the junction.

Second, during and after assembly the engagement of the tang tip with the diode grounding lead is shrouded by the skirt 26*a* of the rearward half-body 20*a*. This condition makes proper assembly much more difficult, and later makes visual inspection of the finished solder joint essentially impossible.

Also shown in FIG. 9 is a variant form of environmental seal 68*a*. Whereas the seal 68 of FIG. 2 is a perforated unitary sheet serving and overlying all the contact-mount bores in common, each seal 68*a* of FIG. 9 is an individual element associated with just one corresponding contact 10, 10*a* and its respective bore 64, 64'.

Moreover each seal 68*a* in FIG. 9 extends into the contact bore, and by virtue of resilient environmental ribs 68*a*'' grips the interior of the bore. (Here as in the illustration of the springs 54, 54'' the ribs 68*a*'' are schematically drawn undeflected, so that they appear to penetrate or overlap the solid conductive bulkhead 64. In actuality the ribs 68*a*'' are strongly deformed, flattened against and into the mass of the seal 68*a*.)

This seal configuration does have the benefit of firmly stabilizing the forward contact structure relative to its bore, so that the integrity of the assembly is less susceptible to transverse forces—such as mentioned above in relation to cable flexing and twisting. Even when the second contact structure 40*a* is not being used as a cable termination, mishandling of open connectors in the field can generate such lateral forces.

Selection between the two types of environmental seal depends upon the application involved. In some situations, particularly military procurements, the unitary sheet-style seal 68 is required.

Figure 10:
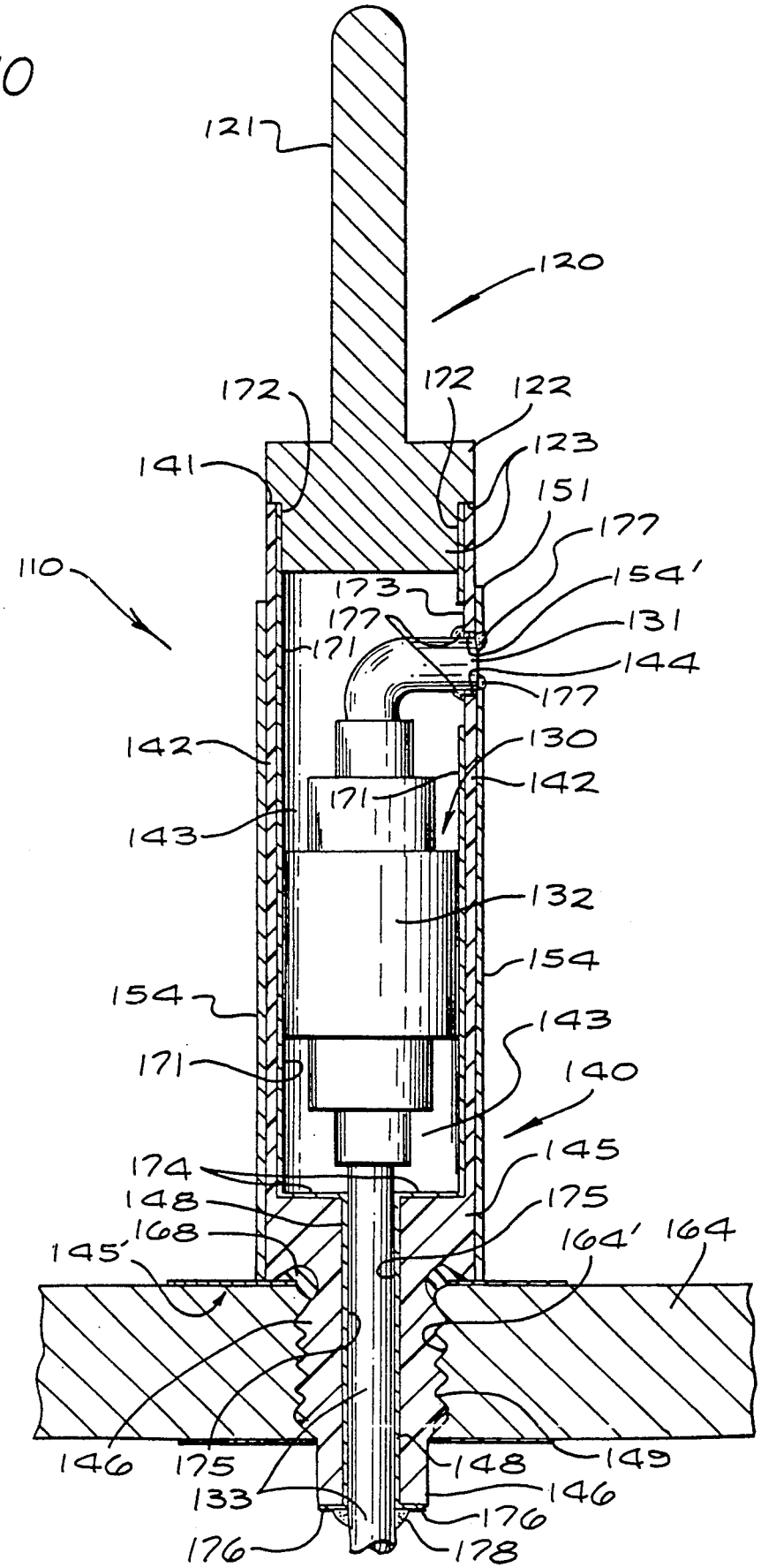
FIG. 10 is a longitudinal section of a diode contact in accordance with a second preferred form of our invention. As in FIG. 1, the diode is not drawn in section.
Figure 11:
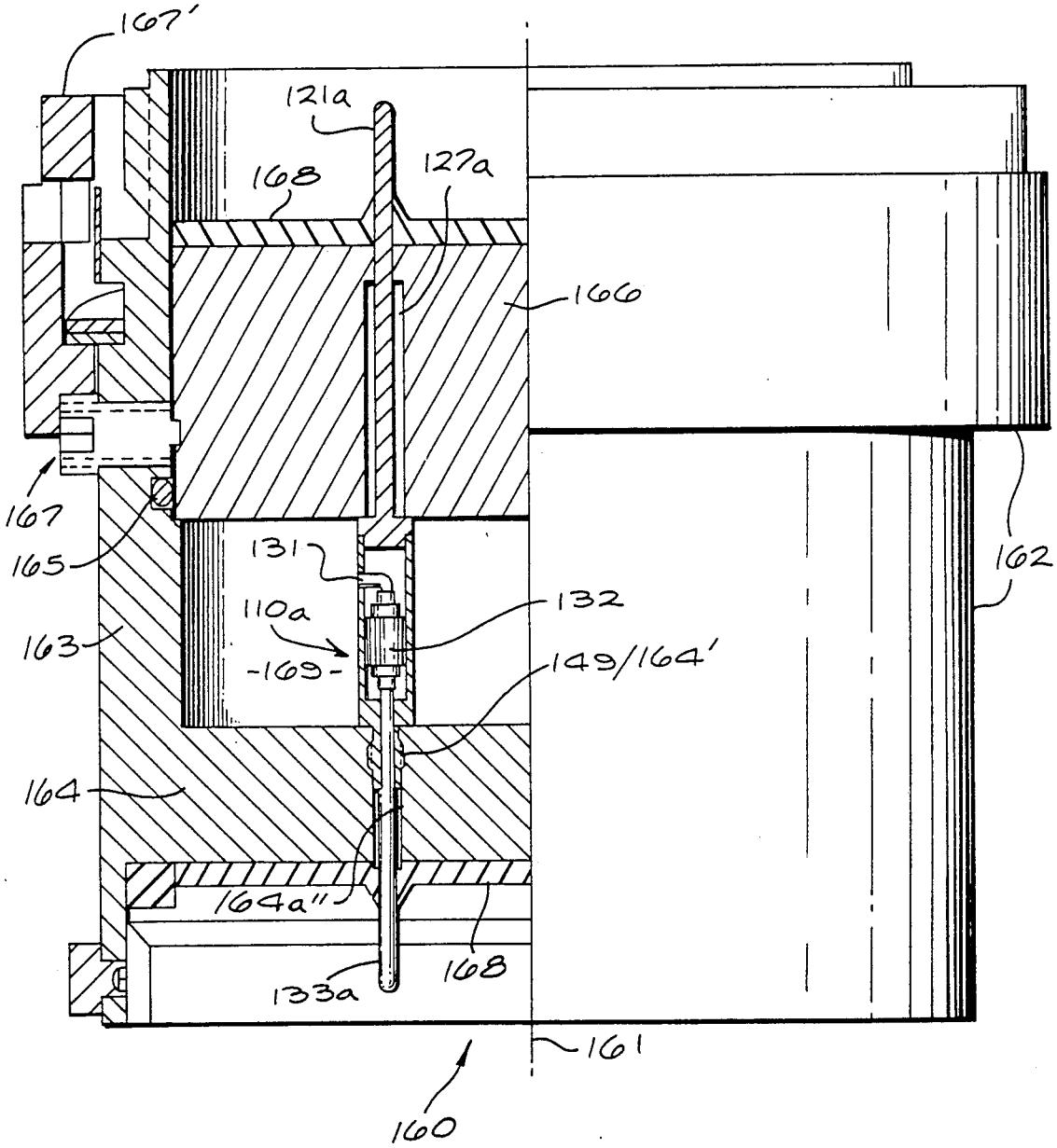
FIG. 11 is a like section of the FIG. 10 diode contact installed in a representative position in a connector which typically has many contacts installed. Like FIG. 2, this drawing also represents a multicontact connector that is another preferred embodiment of our invention.
Figure 12:
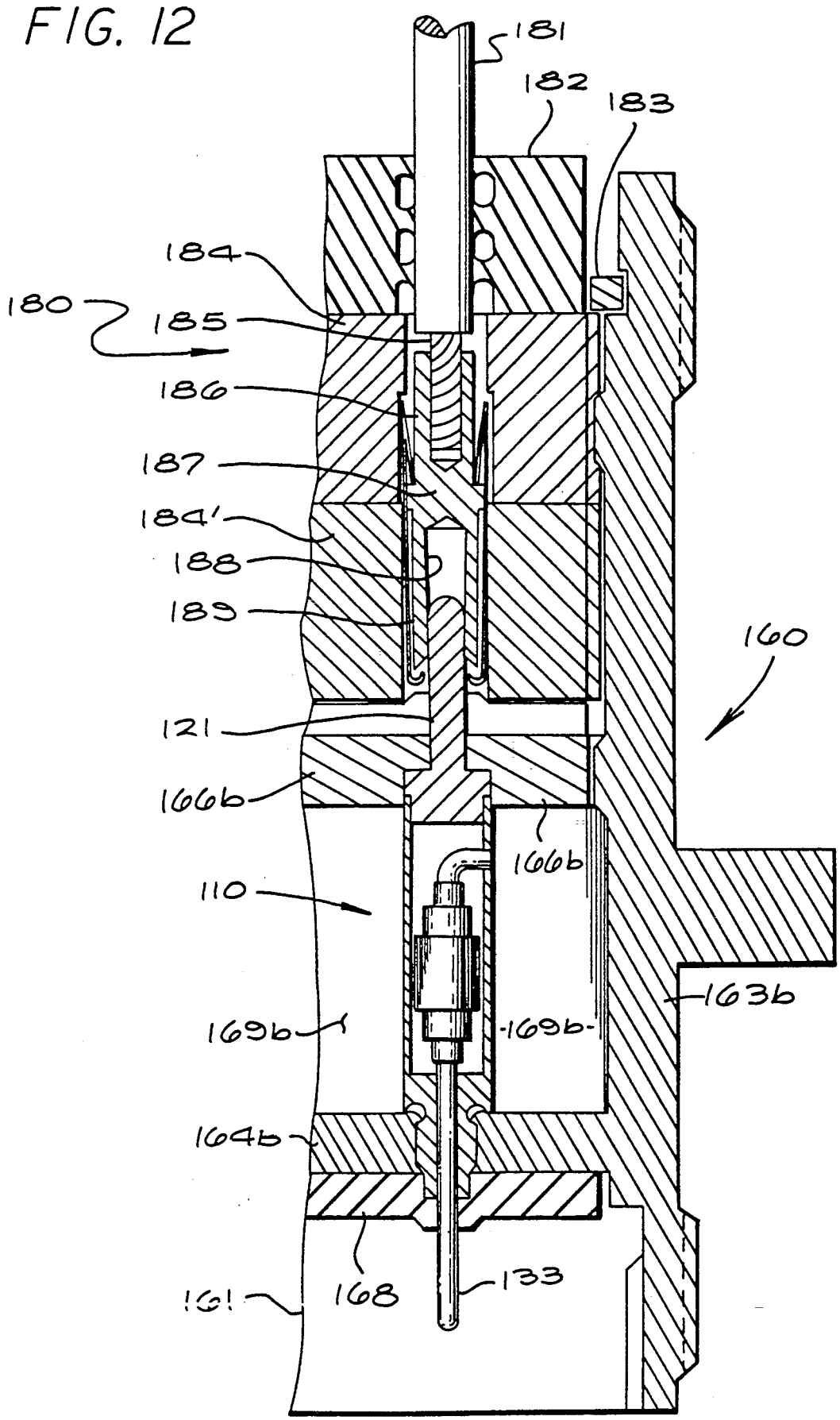
FIG. 12 shows a variant usage or application of the FIG. 11 connector.
Figure 13:
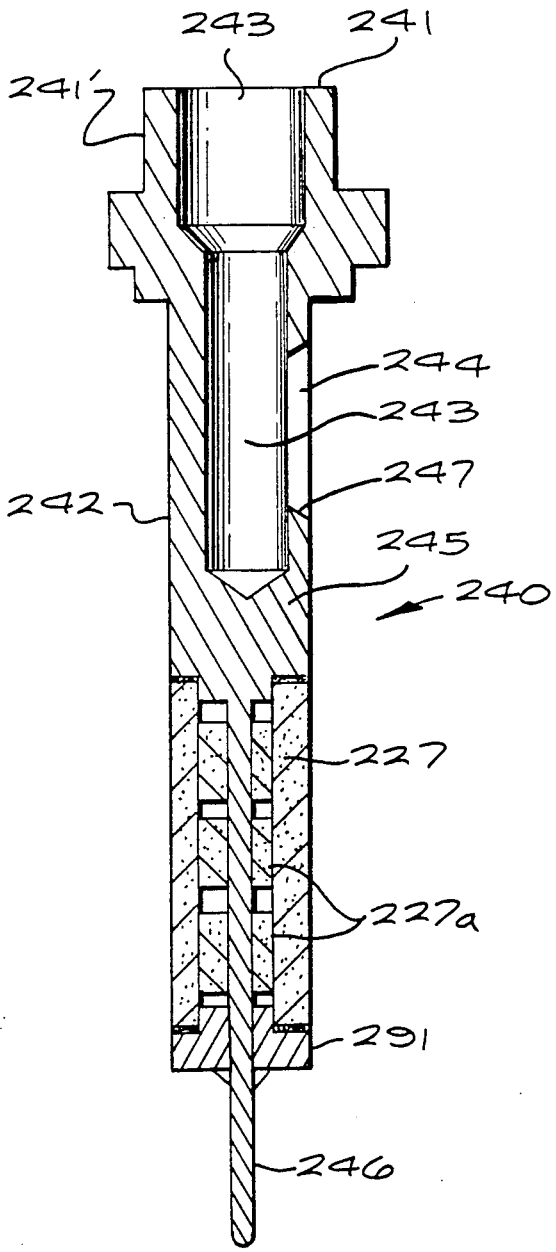
FIGS. 13 through 15 are schematically drawn longitudinal sections showing preliminary and intermediate assembly steps for a third preferred form of the invention.
Figure 14:
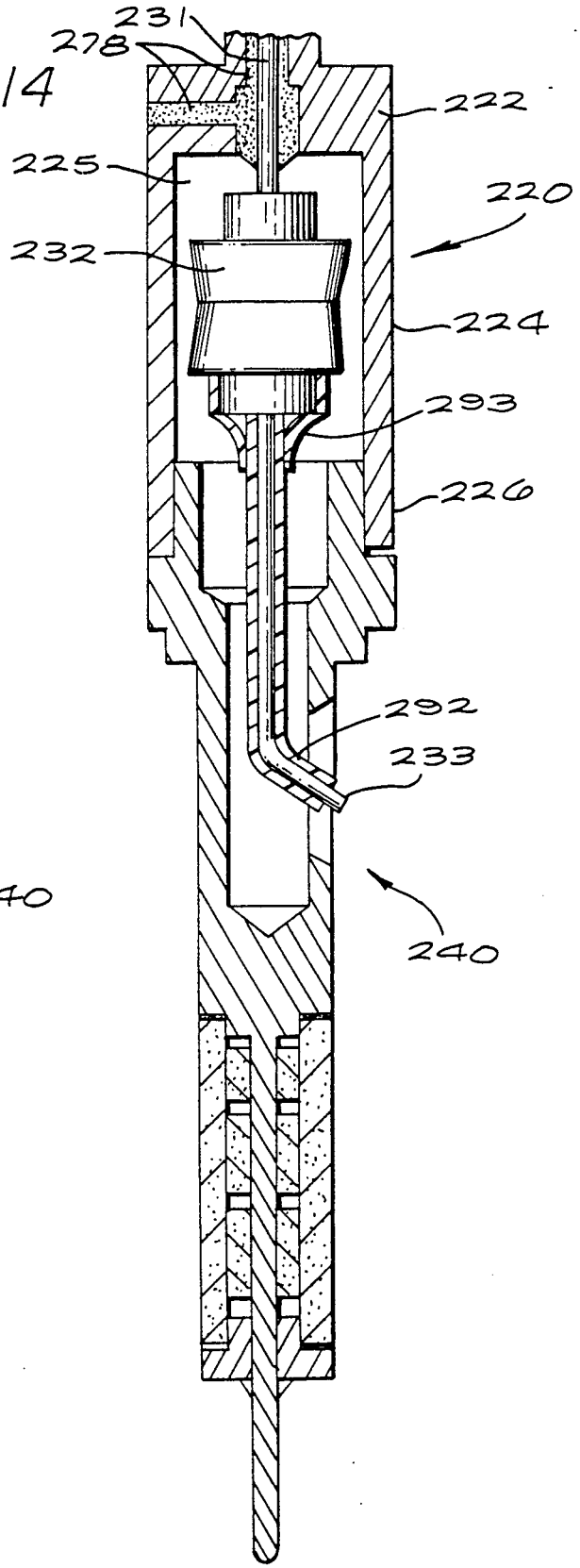

As shown in FIGS. 10 through 12, a second form 110 of our diode contact employs a cast body 140 of electrically insulating material, with conductive coatings 154, 171, 172, 174, 175, 176 applied in selected areas. The body 140 forms a thin cylindrical wall 142, defining a cavity 143 to enclose the diode 130. At the rearward end of the body 140, the wall 142 terminates in an open skirt 141.

Capping this rearward end of the cavity 143 is a mating rearward end structure 120, which includes a slender cylindrical first contact structure 121 and a broader cylindrical transverse wall 122. This wall, on the side opposite from the contact structure 121, is reduced in diameter to fit snugly within the skirt 141 of the cast body 140.

At a forward end of the body, remote from the open skirt 141, the body 140 forms a transverse wall 145, with a generally planar, annular interior surface. Beyond—or forward from—this transverse wall 145, the exterior surface of the body 140 is necked down to form threads 149.

These male threads engage female threads 164' in a transverse bulkhead 164 of the connector housing, firmly securing the diode contact 110 in the bulkhead 164. The necked-down portion 146 of the body 140 protrudes at the other side of the bulkhead 164, terminating in an annular forward end surface that may be generally planar as shown.

Near the rearward end of the body 140, a transverse aperture 144 in the cylindrical wall 142 receives the grounding lead 131 of the diode. At the forward end of the body 140, a longitudinal bore 148 receives the diode signal-path lead 133. The diode signal lead 133 protrudes through both the bore 148 and the connector bulkhead 164, to form a second contact structure at the opposite, or forward, side of the bulkhead.

A first conductive coating 171, on the cylindrical interior surface of the cavity 143, carries electrical signals along the length of the cavity, past the diode body 132. (Coatings are drawn in FIG. 10 with thickness greatly exaggerated.) This coating 171 continues rearward in a conductive coating that makes electrical connection with the rearward end structure 120.

The rearward end structure 120 may be made of either electrically conductive material or conductive-material-coated insulating material. Correspondingly the end structure 120 and body 140 may be secured together by any of a variety of means—including such alternatives as sonic welding, soldering to the interior coating 172 on the skirt 141, and adhesive.

The conductive coating 171 inside the cavity 143 also continues at the forward end of the cavity, in a conductive annular coating 174 on the planar interior end-surface of the cavity. The latter coating in turn continues in a conductive coating 175 on the bore 148 that passes through the contact end wall 145 and the threaded, necked-down forward portion 146 of the body.

Finally, this coating 175 terminates in a conductive coating 176 on the exterior annular end surface of the body 140. Within the bore 148, the coating 175 is in extensive and snug mechanical contact with the forward lead 133 of the diode 130. We consider it preferable, however, not to rely upon this mechanical engagement for electrical interconnection. We prefer to make electrical connection between the exterior annular coating 176 and the diode signal lead 133 by a solder joint 178.

Within the cavity 143, the diode grounding lead 131 is bent in a right angle to pass radially outward through the aperture 144 in the body 140. A very slight flexure of the grounding lead, other parts of the diode, and the cylindrical wall 142, suffices for insertion of the cut-off lead 131 into the cavity 143 without damage to the wall 142. Isolation of the diode grounding lead 131 from the signal path is provided by an annular uncoated area 173 surrounding the aperture 144 in the body 140.

On the exterior surface of the contact, however, is another conductive coating 154, which continues in a coating 154' on the internal cylindrical surface 144 of the aperture. The diode grounding lead 131 is electrically connected with this coating 154, 154' by an annular solder joint 177 that may as shown surround the grounding lead 131 just outside the wall 142, or just inside, or both.

At the rearward end of the body 140, the outer conductive coating 154 stops short of the skirt 141, again to effectively isolate the grounding path from the signal path. At the forward end of the body, however, the outer coating 154 continues onto a forward peripheral or circumferential corner 145' of the body. When the body is threaded into the connector bulkhead 164, the coating 154 is accordingly driven forcibly against the bulkhead.

As in the previously described form of our invention, the bulkhead 164 is preferably an integral structural element of the connector; it is either constructed of electrically conductive material or coated with such material, to form a structurally integral grounding plate that receives voltages bypassed through the diode. In this way the diode grounding lead 131 is effectively connected through the solder joint 177 and conductive coatings 154' and 154 to the bulkhead and grounding plate 164.

In this system, effective environmental guarding is advantageously provided by an annular elastomeric seal 168, captured between the connector bulkhead 164 and the forward wall 145 of the contact body 140. As illustrated, the forward surface of the contact wall 145 is contoured rearward in the region just surrounding the necked-down portion 146.

The resulting shape includes an annular recess, lying radially inward from the peripheral corner 145' mentioned earlier. This recess receives and very tightly constrains the seal 168, while permitting engagement of the coated peripheral corner 145' for electrical continuity.

FIG. 11 shows a variant of the FIG. 10 diode contact, in a connector installation closely analogous to that of FIG. 2. The principal differences between the parts of the FIG. 10 and FIG. 11 diode contacts are in the forward and rearward contact structures, those in FIG. 11 being extended considerably.

In particular, the rearward contact structure **121*a* in FIG. 11 is long enough to accommodate an annular filter element 127*a*; and the forward contact structure—i.e., the signal lead 133*a* of the diode—is elongated as well, and also larger in diameter. The latter effect may be achieved by soldering or otherwise securing the signal lead 133*a* itself into a bore (not illustrated) in the rearward end of an extension. The resulting additional annular cavity 164*a*"** may be used for another filter element if desired.

Reference numerals used for the various elements appearing in FIGS. 10 and 11 are the same as those used for the analogous elements in FIGS. 1 through 9, except for the addition of a prefix "1". In addition, reference numerals in FIG. 11 that are variants of corresponding elements in FIG. 10 carry an additional suffix "a". Based on these conventions, a person skilled in the art of electrical connectors will need no further discussion of the details of FIG. 11.

On the other hand, the diode contact 110 of FIG. 10 can be employed in conjunction with a variant connector geometry as shown in FIG. 12. Here the connector elements analogous to those of FIG. 11 are identified by the same reference numerals with a suffix "b".

The FIG. 12 connector has relatively thin transverse elements **164*b*, 166*b*—allowing no extra length for filters. The rearward portions of this connector are, however, elongated to permit insertion and capture of a simple mechanical plug or jack 180**.

This jack does not accommodate diodes or other voltage-bypassing elements. It does, however, incorporate a female contact 186–189 to make a permanent connection with each respective cable conductor 185—and to provide a repeatably made (and broken) connection with each respective first contact structure 121.

More specifically, the jack 180 services a plurality of insulated cable conductors 181. It includes a resilient strain-relief element 182, a retainer ring 183, and a rearward transverse body 184 that is fixed to a forward transverse body 184'.

Each jack contact 186–189 is captured by a central flange 187 between the forward and rearward bodies 184, 184' of the jack. The rearward half 186 of each jack contact 186–189 has a central bore—into which is crimped or soldered, or both, one of the bared conductors 185 of the cable.

The forward half of each jack contact is also formed with a central bore 188, having an inwardly tapered skirt 189, to function as a female contact structure, receiving the male rearward contact structure 121 of a corresponding diode contact 110. The inward taper of the skirt 189 provides a sliding interference fit between these female and male contact structures.

To the extent that the retaining ring 183 is easily accessible, removable and replaceable, the attachment of the jack 180 to the rest of the connector 160 may be regarded as relatively temporary; and conversely. To the extent that the attachment is considered relatively temporary, the diode connector 160 may then be regarded as a "diode adapter"—terminology whose meaning has already been introduced in connection with FIG. 2.

If the attachment is made relatively permanent, the connector 160 may instead serve as a modular and readily serviced cable termination with diode contacts. As suggested earlier, an even more permanent connection can be provided by eliminating the jack 180 as an independent structure, and providing instead for direct attachment of each conductor 185 to the first contact structure 121 of the respective diode contact 110.

The diode-contact forms of FIGS. 10 through 12 are cast in plastic, and copper coated. We have found by trial and experiment that these copper-coated-plastic forms are advantageous in cost, and also in ease and reliability of assembly, relative to the metal forms shown in FIGS. 1 through 9.

In comparison with the metal forms, however, the plastic prototypes which we constructed were less resistant to mechanical failure upon installation into a connector bulkhead 164. Threading of the contacts into the bulkhead requires careful application of a precisely correct level of torque, and this care and precision must be exercised in close quarters.

On the other hand, in objective evaluation of the plastic forms of our contacts we must point out that these prototypes were directed to applications of the most extremely demanding character. Those applications required very close spacing of adjacent contacts, combined with highly elongated contact structures, and also accompanied by the need for environmental seals 168.

With applications that are amenable to design for additional strength in the region of the necked-down forward portion 146, and particularly at the annular recess for the seal 168, the forms of FIGS. 10 through 12 may be preferred. This could be the case, for example, where no environmental seal is needed or where spatial constraints are relaxed.

FIGS. 13 through 23 represent a third form of our diode contact, and a connector using a multiplicity of contacts in this form. FIGS. 17 through 22 show component parts in accurate proportions; the other figures in this group are more schematic. Again to minimize the need for additional description the reference numerals used in these drawings are the same as for analogous elements of FIGS. 1 through 9, but with a prefix "2".

As will be recalled, the diode 30 in FIGS. 1 through 9 is oriented with its grounding lead 33 toward the forward end of the contact, linked with a grounding spring through an axial slot 56 in the end wall 45 of the cavity 34. The diode 130 in FIGS. 10 through 12 is oriented with its grounding lead 131 toward the rearward end of the contact, linked with a grounding coating through a radial aperture 144 in the side wall 142 of the cavity 134.

In FIGS. 13 through 23 the orientation and access are in yet a different combination. The diode grounding lead 233 is disposed toward the forward end, but linked with a grounding spring 254 through a radial aperture 244 in the side wall 242. A solder joint 277 (FIG. 16) completes the connection between the diode grounding lead 233 and a groove 252 in the rearward end of the spring 254.

Insulating the diode grounding lead 233 from the interior cylindrical wall 242 of the cavity is a small-diameter sleeve 233 that encircles nearly the entire grounding lead 233—all but the tip. The original end segment 233' (FIG. 19) of the diode lead 233 is trimmed away after being used to hold the diode for cleaning and for forming of the lead itself. The original closed end 294 of the sleeve also is trimmed away during assembly. If desired, the diode can be further protected by a larger, shrinking-type sleeve 293 that covers both the forward contact section of the diode body 232 and the rearward end of the small-diameter sleeve 233.

A lateral orifice 244, **244*a* for passage of the diode grounding lead 233 is best formed by a circular cutter with diameter sized to produce the curve 244*a*'(FIG. 17), and with width just slightly exceeding the bore 243, 243*a*. The grounding lead 233 is generally centered in this orifice 244 by a stiff insulating and alignment sleeve 257 that encircles the exterior of the forward half-body wall 242**.

A flange 255 formed in the rearward end of this sleeve 257 prevents electrical contact between the body 242 and the rearward end of the grounding spring 250. The forward end of the same sleeve 257 extends slightly over the rearward end of the cylindrical filter 227, to prevent contact between the body 242 and spring 254 in that region.

Each half-body and contact structure 220, 240 is of metal; the two are fastened together by solder, brazing or other appropriate means. Ferrite-core filters **227*a* as well as a cylindrical L-C filter 227 can be slid onto the forward contact structure 246—or onto the rearward contact structure 221**—in this form of the contact, and in the earlier-described forms as well.

Figure 23:
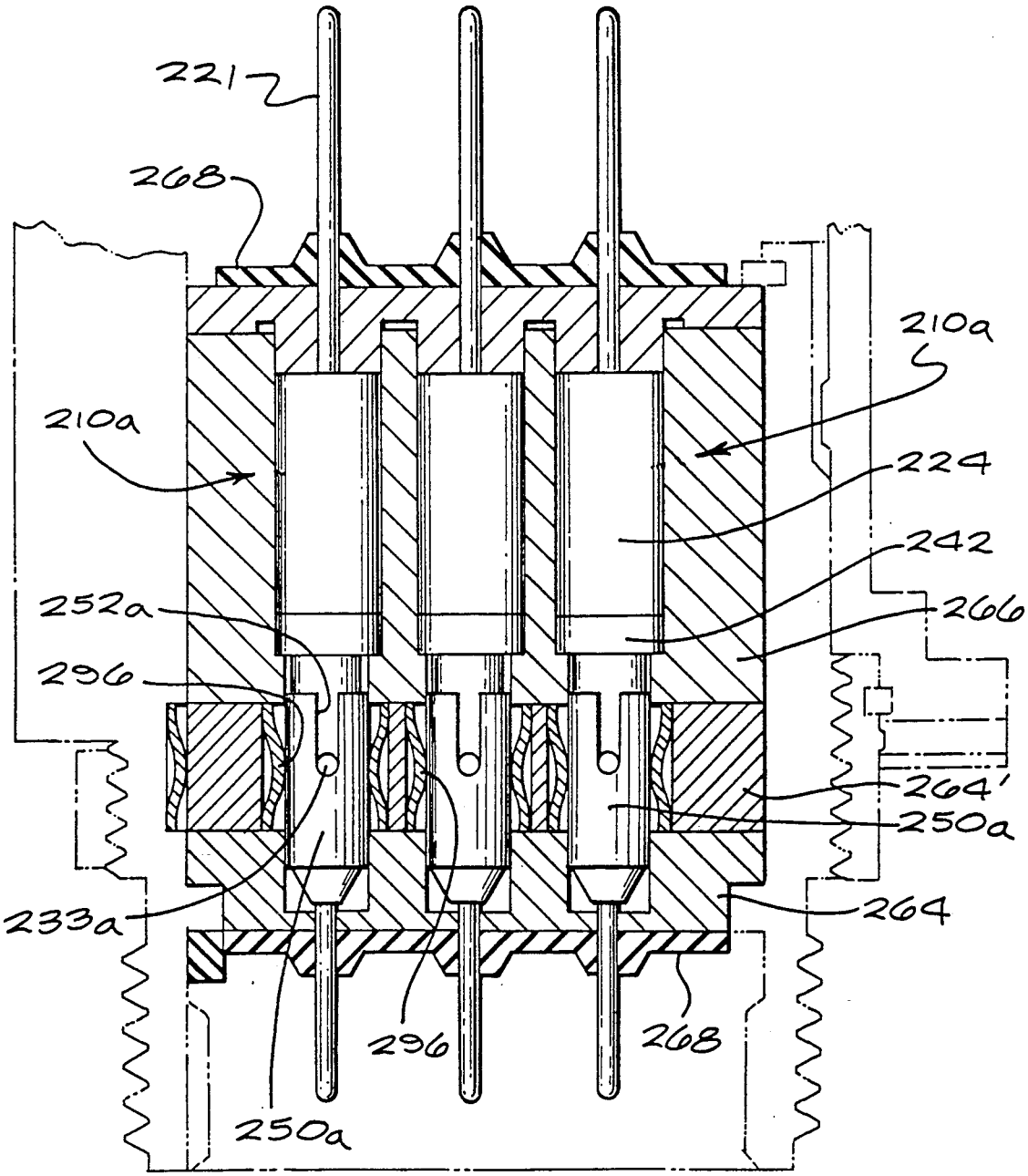
FIG. 23 shows a representative plurality of the FIG. 16 contacts installed in a connector. The exterior surfaces of the contacts and a cross-section of the other elements of the connector appear in this drawing. Like FIGS. 2 and 11, this drawing also represents a multicontact connector that is another preferred embodiment of our invention.
Figure 24:
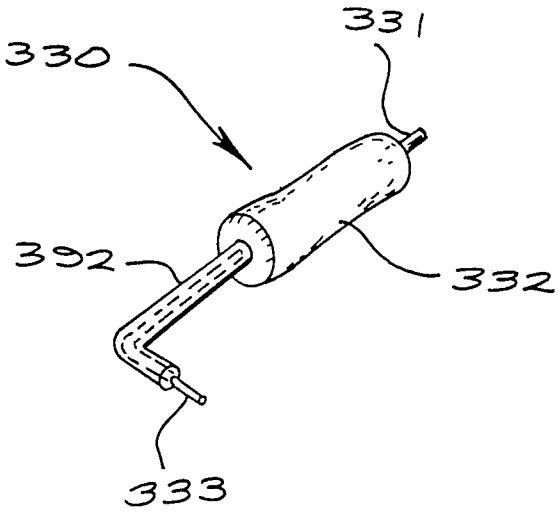
FIGS. 24 through 29 represent another construction of the FIG. 16 contact. Here the contact body is formed as a longitudinally, rather than transversely, split case.
Figure 25:
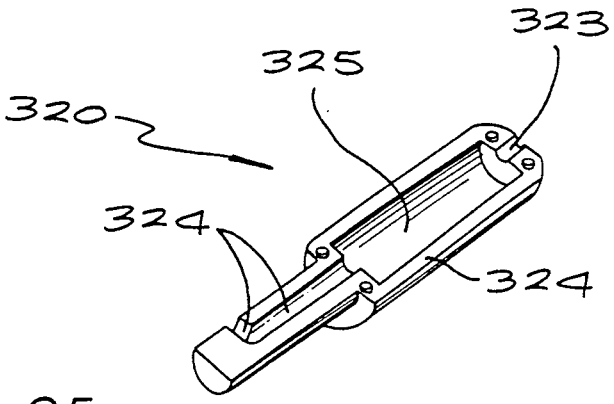
Figure 26:
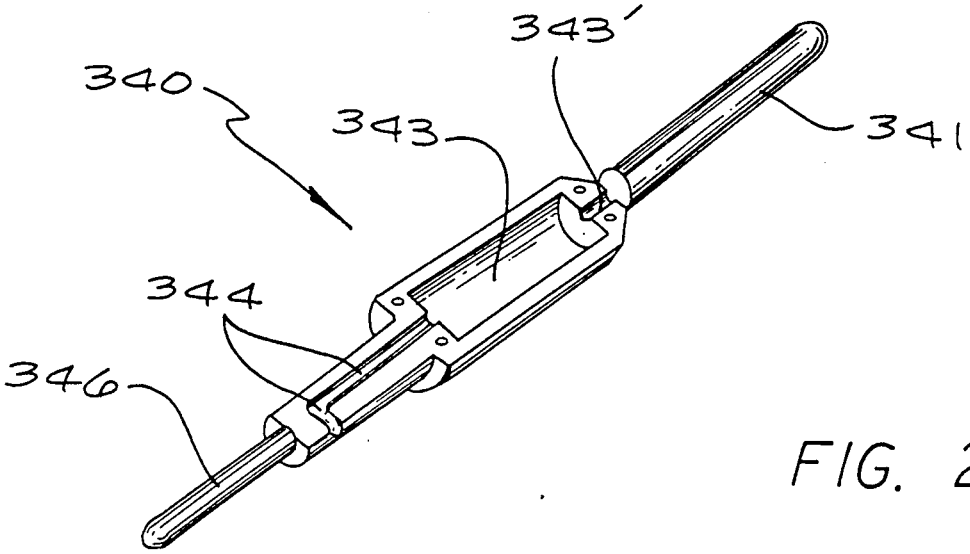
Figure 27:
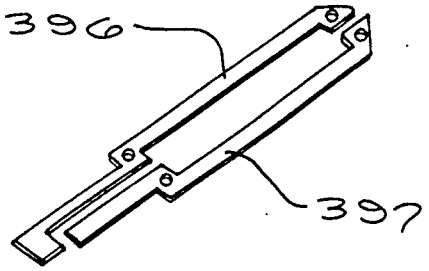
Figure 28:
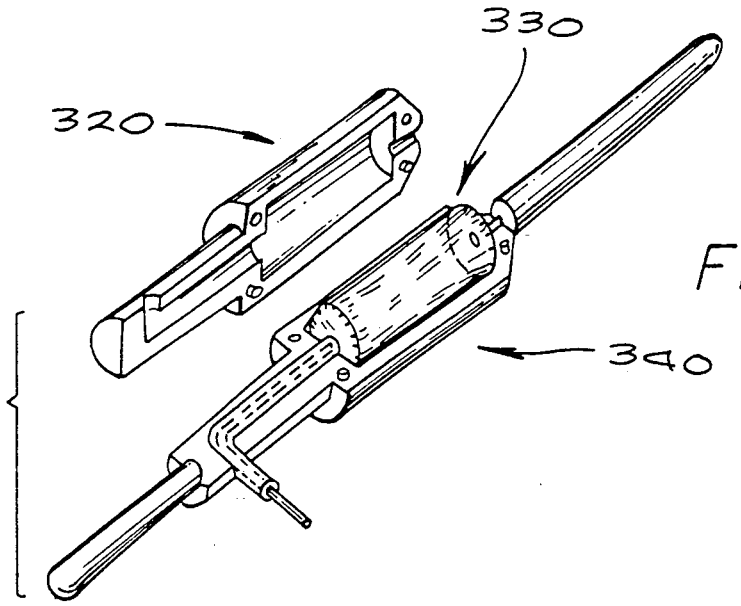
Figure 29:
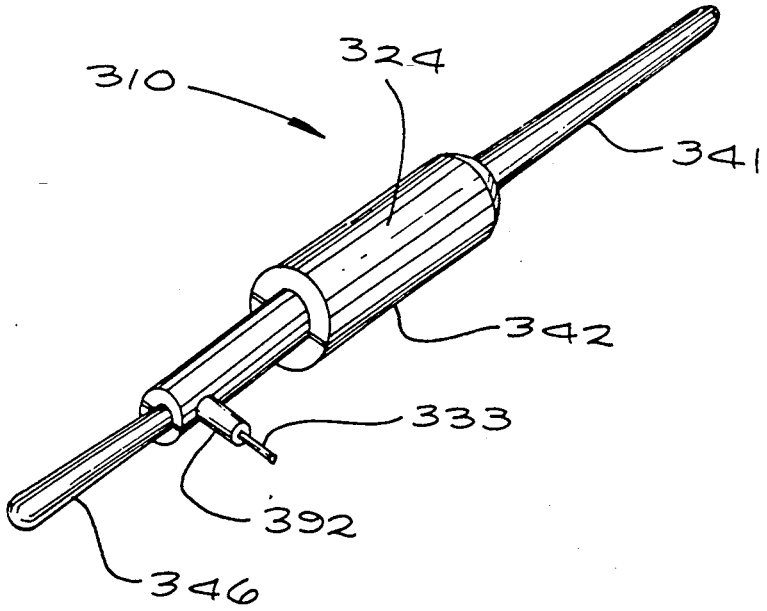

In this case, the filters 227, **227*a* are held in place by a metallic retainer ring 291, which is also slid over the contact structure 246 and soldered in place. The exterior cylindrical surface of the cylindrical filter 227 is grounded (FIG. 16) through a section 254' of the same grounding spring 250 that grounds the diode grounding lead 233 to the connector 264 (FIG. 23**).

Figure 20:
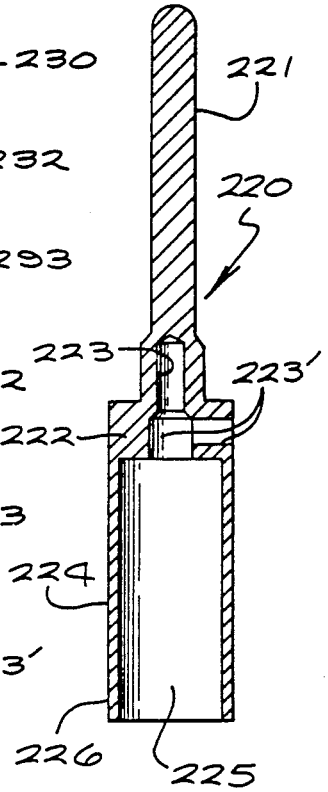

The signal lead 231 of the diode is secured and electrically connected to a bore in the first contact structure 231 by a solder joint 278. For best visibility and access, solder 278 is advantageously fed to this joint through a lateral aperture and counterbore 223' (FIG. 20).

Figure 21:
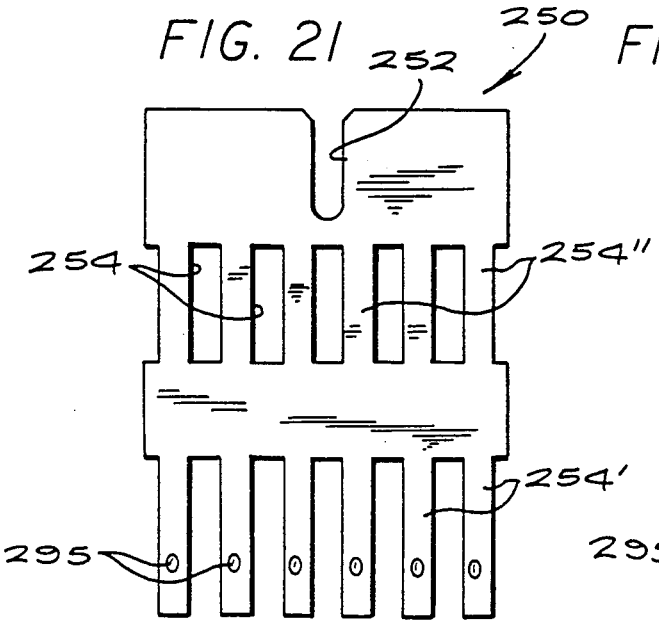

The grounding spring 250 is first stamped from flat sheet stock as shown in FIG. 21, with a rearward notch 252 to receive the tip of the grounding lead 233, and several slots 254 to define individual spring strips 254''. Similarly formed tangs 254' extend forward, and a small oval area 295 near the tip of each tang is dimpled inward for better contact with the cylindrical filter 227.

This flat pattern is bent so that the spring strips 254'' bulge upward (as drawn) out-of-plane, and the lower tangs 254' are inclined downward. Then the structure is rolled about a mandrel to provide the generally cylindrical spring shown in FIG. 22.

In the connector of FIG. 23, each contact has a variant grounding ring that is essentially a cylinder **250*a* with a rearward notch 252*a* for the diode grounding lead 233*a*. Resilient retention for each contact is provided by a separate grounding spring 296, captured within the corresponding bore in an apertured insert 264'. That insert is disposed between the connector bulkhead 264 and a rearward transverse element 266**.

Alternative constructions for the body portions 220, 240 of the diode contact in FIGS. 13 through 23 include the longitudinally split casing shown in FIGS. 24 through 29. Here each half-body section 320, 340 defines a longitudinal half-cavity 325, 343 respectively.

Each half-body 320, 340 is channeled at 323, 343' respectively to receive the diode signal lead 331; and at 324, 344 respectively to receive the grounding lead 333 in its insulating sleeve 392. These channels divide the mating surface areas into two noncontiguous parts, which must be separately sealed by respective separate solder preforms 396, 397.

Figure 15:
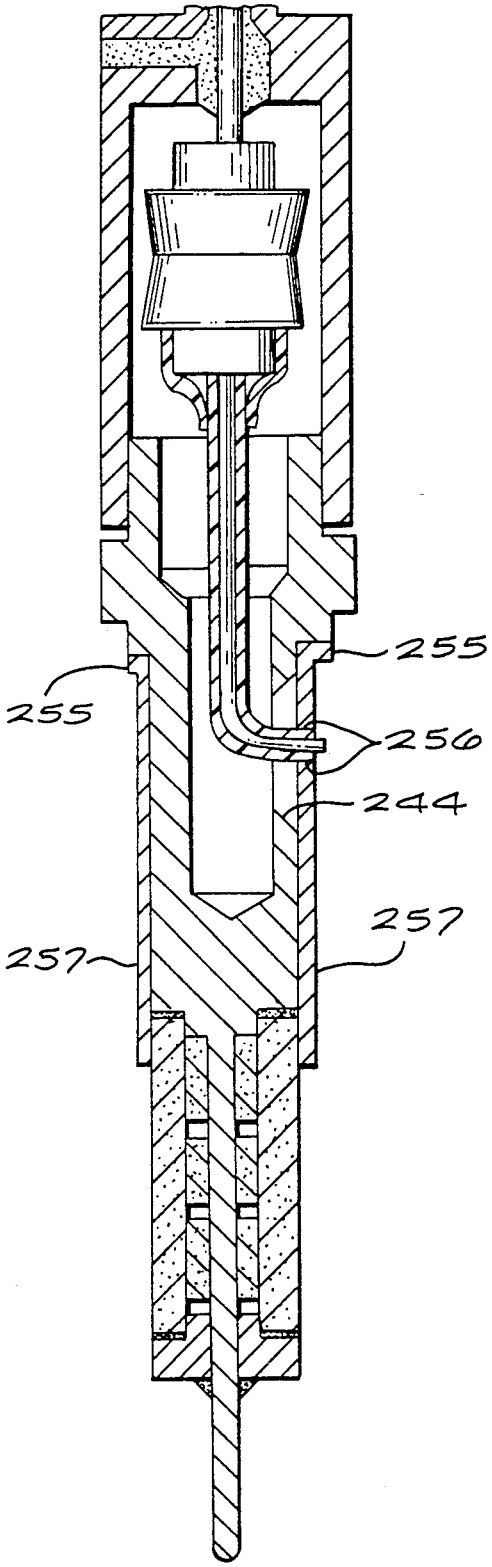
Figure 16:
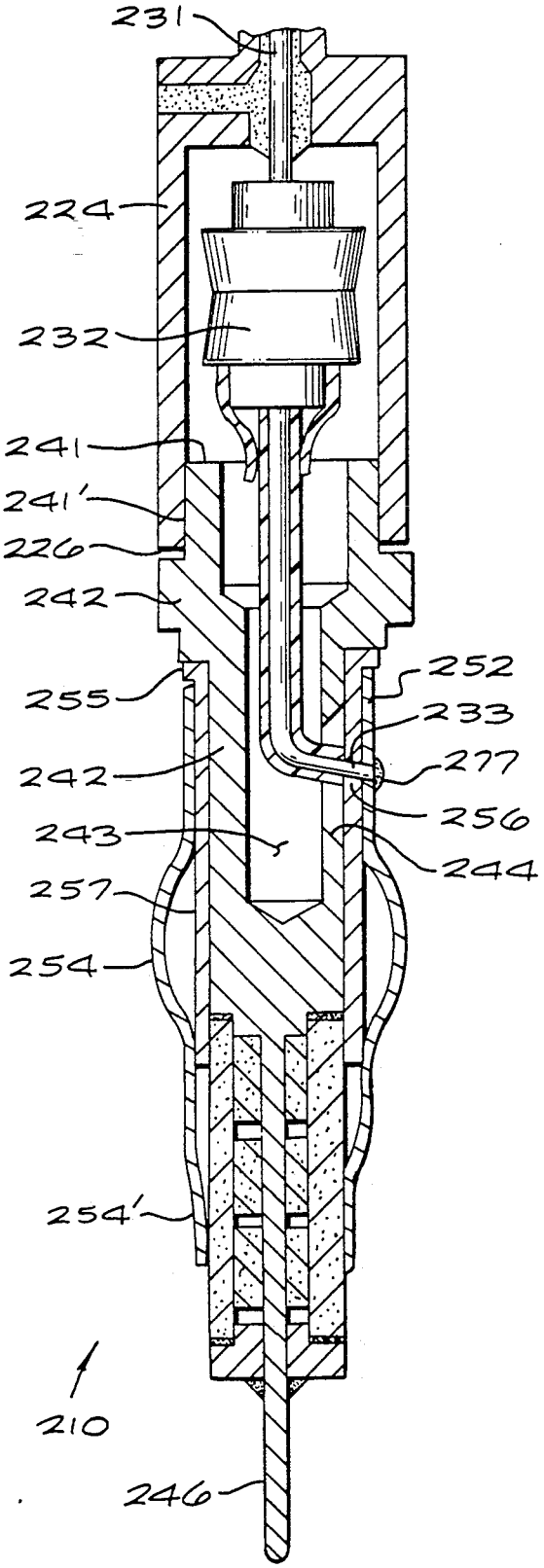
FIG. 16 is a like longitudinal section showing the final assembly of the third preferred form of our diode contact, complete with grounding band.
Figure 17:
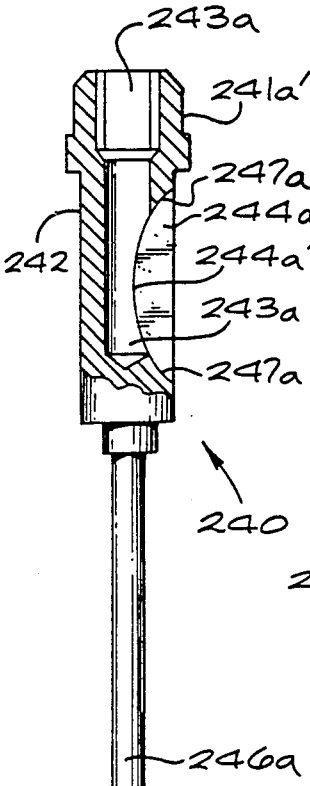
FIGS. 17 through 22 shows components of the FIG. 16 contact more precisely. Specifically.
Figure 18:
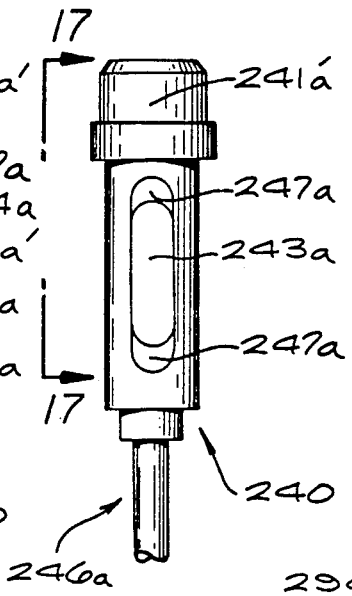
Figure 19:
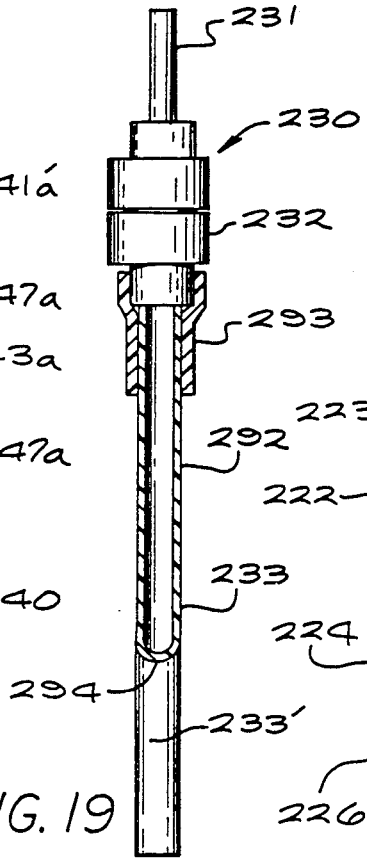

An insulating sleeve similar to the sleeve 257 in FIGS. 15 and 16 can be used with the longitudinally split case and other components of FIGS. 24 through 29. A grounding structure similar to the spring 250 of FIGS. 16, 21 and 22, or the rings 250*a* of FIG. 23, can also be used with this longitudinally split construction.

Following are representative materials, representative approximate dimensions (in inches) and other parameters of some of the systems illustrated and discussed above.

| | | | | |
|---|---|---|---|---|
| FIGS. 1 through 9: | | | | |
| rearward half-body and contact structure 20: | beryllium copper | | | |
| contact structure 21 | diameter | 0.030, | length | 0.716 |
| transverse wall 22 | diameter | 0.085, | thickness | 0.022 |
| bore 23 | diameter | 0.021, | depth | 0.125 |
| shell wall 24 | O. D. | 0.085, | length | 0.192 |
| cavity 25 | I. D. | 0.075, | depth | 0.192 |
| diode: | part designator "transient voltage suppressor" UNITRODE #TS1087 | | | |
| body S2 | diameter | 0.075, | length | 0.175 |
| leads 31, 33 | diameter | 0.020, | length | 0.150 |
| forward half-body and contact structure 40: | beryllium copper | | | |
| shell wall 42 | O. D. | 0.085, | length | 0.142 |
| cavity 43 | I. D. | 0.063, | depth | 0.182 |
| slot 44 (incl. end 48) | width | 0.052, | length | 0.135 |
| transverse wall 45 | diameter | 0.085, | thickness | 0.019 |
| contact structure 46 | diameter | 0.030, | length | 0.496 |
| spring and tang 51-54 | beryllium copper | | | |
| stamped sheet overall | width | 0.149, | length | 0.319 |
| tang tip aperture 52 | diameter | 0.025 | | |
| tang 53 | width | 0.040, | length | 0.186 |
| spring section 54 | length | 0.133 | | |
| spring strips 54" | width | 0.014, | length | 0.097 |
| interstrip slots 54' | width | 0.016, | length | 0.097 |
| outer insulating sleeve 55-59: | plastic | | | |
| large flange 56 | diameter | 0.086, | thickness | 0.031 |
| central cylinder 57 | O. D. | 0.050, | wall | 0.009 |
| small flange 58 | diameter | 0.066, | thickness | 0.019 |
| bore | diameter | 0.031, | length | 0.185 |
| inner insulating sleeve (not shown) on tang: | Teflon, TFE (reg'd trademarks) | | | |
| | thickness | 0.002, | length | 0.140 |
| potting compound to fill cavity 43 | RTV silicone rubber durometer 40 to 50 | | | |
| connector structure 60: | aluminum | | | |
| shell 63 | wall thickness | 0.124 | | |
| bulkhead 64 | thickness | 0.247 | | |
| FIGS. 10 through 12: | | | | |
| rearward cap and contact structure 120: | material | copper alloy | | |
| contact structure 121 | various dimensions as to pin or socket | | | |
| transverse wall 122 | diameter | 0.088, | thickness | 0.025 |
| diode 130: | component designator "transient voltage suppressor" UNITRODE #TS1087 | | | |
| body 132 | diameter | 0.075, | length | 0.175 |
| lead 131 | diameter | 0.020, | length | 0.050 |
| lead 133 | diameter | 0.020, | length | various |
| molded contact body 140: | material | polyetherimide resin | | |
| shell wall 142 | O. D. | 0.088, | thickness | 0.006 |
| cavity 143 | I. D. | 0.076, | depth | 0.272 |
| transverse wall 145 | diameter | 0.088, | thickness | 0.025 |
| external thread 149 | pitch | 80, | depth | 0.007 |
| | root diameter | 0.041 | | |
| necked-down part 146 | diameter | 0.038, | length | 0.020 |
| bore 148 | diameter | 0.023, | length | 0.128 |

-continued

| | | | | |
|---|---|---|---|---|
| coatings 171-176 | material | copper, nickel, gold | | |
| | thickness | 0.0006, 0.00003, 0.00007 | | |
| connector parts, as above | aluminum | | | |
| FIGS. 13 through 23: | | | | |
| rearward half-body and contact structure 220: | beryllium copper | | | |
| contact structure 221 | diameter | 0.04 at bore, 0.03 elsewhere; | | |
| | length | 0.3 | | |
| bore 223 | diameter | 0.02, | depth | 0.07 |
| enlarged counterbore 223' for solder | diameter | 0.03, | depth | 0.03 |
| solder access 223' | diameter | 0.02 | | |
| wall 222 | diameter | 0.084, | thickness | 0.04 |
| shell wall 224 | O. D. | 0.084, | thickness | 0.0045 |
| cavity 225 | I. D. | 0.075, | depth | 0.21 |
| diode 230: | component designator "transient voltage suppressor" MICROSEMI #MC510457 | | | |
| body 232 | diameter | 0.074, | length | 0.14 |
| leads 231, 233 | diameter | 0.018, | copper | |
| sleeve 292 on lead 233 | Teflon, TFE (reg'd trademarks), | | | |
| | I. D. | 0.018, | gauge | 26, |
| | wall thickness | 0.006 | | |
| larger oversleeve 293 | Kynar (reg'd trademark) shrink tubing | | | |
| | I. D. | 0.048 (0.023 recovered) | | |
| | wall thickness | 0.01 | | |
| forward half-body and contact structure 240: | beryllium copper | | | |
| bore 243a | diameter | 0.03, | depth | 0.19 |
| aperture 244a | width | 0.032, | open length | 0.1 |
| cut curve 244a' | diameter | 0.1875 | | |
| contact structure 246a | diameter | 0.037 at hub, 0.019 elsewhere; | | |
| | length | 0.58 | | |
| grounding spring 250: | beryllium copper | | | |
| stamped sheet overall | width | 0.24, | length | 0.34 |
| same, rolled | diameter | 0.086 (with 0.075 tool inside) | | |
| same, at strips 254" | diameter | 0.1 (with tool) | | |
| notch 252 | width | 0.02, | length | 0.07 |
| spring strips 254" | width | 0.02, | length | 0.075 |
| interstrip slots 254 | width | 0.02, | length | 0.075 |
| forward tangs 254' | width | 0.02, | length | 0.13 |
| dimples 295 | major/minor axes | 0.016/0.01 | | |
| | deflection | 0.001 to 0.003 | | |
| connector parts, as above | aluminum | | | |

It will be understood that the foregoing disclosure is intended to be merely exemplary, and not to limit the scope of the invention—which is to be determined by reference to the appended claims.

We claim:

1. A contact for an electrical connector, comprising:

a generally cylindrical body;

a cavity that is substantially central, with respect to the radial dimensions of the body, said cavity being defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path.

2. The contact of claim 1, wherein:
the body comprises a segment that is axially displaced from the cavity;
the electrical ground path is formed at the outside of the axially displaced segment; and
the first connecting means comprise an axially extending conductive element interconnecting the first one of the leads with the ground path.

3. The contact of claim 2, wherein:
the axially extending element projects axially through a wall of the body.

4. The contact of claim 2, wherein:
the axially extending element is integral with the grounding path, and inside the body connects with the first one of the leads.

5. The contact of claim 4, wherein:
the ground path is formed as a grounding band substantially encircling the axially displaced segment; and
the axially extending element is an extension of the grounding band.

6. The contact of claim 5, wherein:
the band is a formed sheet-metal spring, with a long tang serving as the axially extending element.

7. The contact of claim 2, further comprising:
an annular insulator on the axially displaced segment, separating the ground path from the axially displaced segment; and
wherein the axially extending element projects axially through a wall of the insulator.

8. The contact of claim 2, further comprising:
an annular insulating spacer on the axially displaced segment, for helping to locate the contact in a grounding structural member of such connector.

9. The contact of claim 1, wherein:
the cavity is substantially coaxial with the body.

10. The contact of claim 9, wherein:
the body comprises a substantially tubular wall encircling the electrical component.

11. The contact of claim 10, wherein:
the wall is a substantially annular cylinder.

12. The contact of claim 11, wherein:
the wall, where it encircles the electrical component, is circumferentially unitary and continuous.

13. The contact of claim 11, wherein:
the wall, where it encircles the electrical component, is substantially unitary and continuous.

14. A contact for an electrical connector, comprising:
a generally cylindrical body;
a generally central cavity defined within and extending axially within the body;
at at least one axial end of the cavity, a contact structure integral with or secured to the body;
an electrical signal path formed along the body and continuing in the contact structure;
an electrical ground path formed at the outside of the contact;
an electrical component disposed within the cavity and having a pair of electrical leads;
first means electrically connecting a first one of the leads to the ground path; and
second means electrically connecting a second one of the leads to the signal path; and wherein:
the body comprises a segment that is axially displaced from the cavity;
the electrical ground path is formed at the outside of the axially displaced segment; and
the first connecting means comprise an axially extending conductive element interconnecting the first one of the leads with the ground path; and
the axially extending element passes through a slot formed in the body adjacent to the axially displaced segment.

15. A contact for an electrical connector, comprising:
a generally cylindrical body;
a generally central cavity defined within and extending axially within the body;
at at least one axial end of the cavity, a contact structure integral with or secured to the body;
an electrical signal path formed along the body and continuing in the contact structure;
an electrical ground path formed at the outside of the contact;
an electrical component disposed within the cavity and having a pair of electrical leads;
first means electrically connecting a first one of the leads to the ground path; and
second means electrically connecting a second one of the leads to the signal path; and wherein:
the body comprises a segment that is axially displaced from the cavity and is of reduced diameter;
a slot is formed in the body adjacent to the axially displaced segment;
the ground path is a formed sheet-metal spring substantially encircling the outside of the axially displaced portion; and
the first connecting means comprise an integral extension of the grounding spring, that projects axially through the slot formed in the body, and inside the body connects with the first one of the leads.

16. A contact for an electrical connector, comprising:
a generally cylindrical body;
a generally central cavity defined within and extending axially within the body;
at at least one axial end of the cavity, a
the axially extending element is integral with the grounding path, and inside the body connects with the first one of the leads;
the ground path is formed as a grounding band substantially encircling the axially displaced segment;
the axially extending element is an extension of the grounding band;
the band is a formed sheet-metal spring, with a long tang serving as the axially extending element; and
the first connecting means further comprise a solder joint within the cavity.

17. A contact for an electrical connector, comprising:
a generally cylindrical body;
a generally central cavity defined within and extending axially within the body;
at at least one axial end of the cavity, a contact structure integral with or secured to the body;
an electrical signal path formed along the body and continuing in the contact structure;
an electrical ground path formed at the outside of the contact;
an electrical component disposed within the cavity and having a pair of electrical leads;
first means electrically connecting a first one of the leads to the ground path; and
second means electrically connecting a second one of the leads to the signal path; and wherein:
the body comprises a segment that is axially displaced from the cavity;

the electrical ground path is formed at the outside of the axially displaced segment;

the first connecting means comprise an axially extending conductive element interconnecting the first one of the leads with the ground path;

the axially extending element is integral with the grounding path, and inside the body connects with the first one of the leads;

the ground path is formed as a grounding band substantially encircling the axially displaced segment;

the axially extending element is an extension of the grounding band;

the band is a formed sheet-metal spring, with a long tang serving as the axially extending element; and the tang has a segment that is bent and perforated for passage of the first one of the leads.

18. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path; and wherein:

the body comprises a segment that is axially displaced from the cavity;

the electrical ground path is formed at the outside of the axially displaced segment;

the first connecting means comprises an axially extending conductive element interconnecting the first one of the leads with the ground path;

the axially extending element is integral with the grounding path, and inside the body connects with the first one of the leads;

the ground path is formed as a grounding band substantially encircling the axially displaced segment;

the axially extending element is an extension of the grounding band;

the band is a formed sheet-metal spring, with a long tang serving as the axially extending element; and further comprising:

a solder preform on the first one of the leads, at a side of the tang that faces the electrical component;

said preform having been melted to form an electrical joint between the first one of the leads and the tang.

19. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path;

wherein, at an end opposite said contact structure, the body is formed into a second contact structure; and further comprising a substantially annular insulating spacer encircling the second contact structure, for helping to locate the contact in a grounding structural member of such connector.

20. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path; and wherein:

the body comprises a segment that is axially displaced from the cavity;

the electrical ground path is formed at the outside of the axially displaced segment; and the first connecting means comprise an axially extending conductive element interconnecting the first one of the leads with the ground path; and further comprising:

an annular insulator on the axially displaced segment, separating the ground path from the axially displaced segment;

a substantially annular insulating spacer encircling the axially displaced segment, adjacent to said annular insulator, for engaging an interior surface of a crossmember of such connector to help locate the contact relative to such crossmember; and resilient circumferential ribs formed on the insulating spacer to seal such connector.

21. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path; and wherein:

the body comprises a segment that is axially displaced from the cavity;

the electrical ground path is formed at the outside of the axially displaced segment; and the first connecting means comprise an axially extending conductive element interconnecting the first one of the leads with the ground path; and further comprising:

an annular insulating spacer on the axially displaced segment, for helping to locate the contact in a grounding structural member of such connector; and resilient circumferential ribs formed on the insulating spacer to seal such connector.

22. The contact of claim 19, further comprising:

resilient circumferential ribs formed on the insulating spacer to seal such connector.

23. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path; and wherein:

a generally radial orifice is defined through the body to communicate with the cavity; and the first one of the leads extends generally radially from the cavity through the orifice and is there electrically connected to the ground path.

24. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path; and wherein:

the body comprises an integral substantially cylindrical wall, encircling and substantially coaxial with the cavity, and enclosing the electrical component;

an orifice is defined through the wall; and the first one of the leads extends generally radially from the cavity and through the wall, and is there electrically connected to the ground path.

25. The contact of claim 24, wherein:

the body substantially fully encloses the electrical component.

26. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path;

wherein the second one of the leads extends axially from the cavity at a second axial end of the cavity, opposite from the contact structure, and is there electrically connected to the signal path.

27. The contact of claim 26, wherein:

the second one of the leads extends axially beyond the body and the second axial end, to form another contact structure at the second axial end.

28. The contact of claim 26, wherein:

at the second axial end, the body or an extension thereof is formed for mechanical and electrical connection with a grounding structural member of such connector.

29. The contact of claim 28, wherein:

at the second axial end the body or extension is formed into threads, for threading into the structural member.

30. A contact for an electrical connector, comprising:

a generally cylindrical body;

a generally central cavity defined within and extending axially within the body;

at at least one axial end of the cavity, a contact structure integral with or secured to the body;

an electrical signal path formed along the body and continuing in the contact structure;

an electrical ground path formed at the outside of the contact;

an electrical component disposed within the cavity and having a pair of electrical leads;

first means electrically connecting a first one of the leads to the ground path; and second means electrically connecting a second one of the leads to the signal path; and wherein:

the body is formed of insulating material;

the electrical ground path comprises first conductive material disposed along the insulating material and electrically interconnected with the first one of the leads by the first connecting means; and the electrical signal path comprises second conductive material disposed along the insulating material and electrically interconnected with the contact structure, and also electrically interconnected with the second one of the leads by the second connecting means.

31. The contact of claim 30, wherein:

the first and second conductive materials are coated on the insulating material.

32. The contact of claim 30, wherein:

the first conductive material is coated on an outer surface of the body; and the second conductive material is coated on an inner surface of the body, within the cavity.

33. The contact of claim 32, wherein:

the second conductive material extends to and touches the contact structure.

34. A contact for an electrical connector that has a grounding structural member; said contact comprising:

a generally cylindrical body of conducting material for insertion into such connector;

a substantially coaxial central cavity defined within and extending axially within the body, and a generally tubular wall of the body enclosing the cavity;

at a first axial end of the body, a first contact structure integral with or secured to the body and substantially terminating a first end of the cavity;

at a second axial end of the body opposite the first end of the body and substantially terminating a second end of the cavity, a second contact structure integral with or secured to the body for extension out of such connector; the body forming an electrical-signal-carrying path between the first and second contact structures;

a substantially axial hole defined in the first contact structure and communicating with the central cavity;

an aperture defined through the body near the second contact structure and communicating with the central cavity;

encircling the second contact structure, an insulating sleeve;

encircling the insulating sleeve, a conductive band forming an electrical grounding path at the outside of the second contact structure, and disposed for contact with such grounding structural member when the body is inserted into such connector;

an electrical component disposed substantially axially within the cavity and having a pair of electrical leads extending axially within the cavity;

a first one of the leads further extending axially from the cavity into said hole in the first contact structure;

an axial extension of the conductive band extending axially therefrom, and further extending through said aperture and into the cavity; and there making electrical contact with a second one of the leads;

a first solder joint electrically connecting the first one of the leads with the first contact structure;

a second solder joint electrically connecting the extension of the conductive band with said second one of the leads; and whereby the component lies in an electrical path between the grounding band and the signal-carrying body.

35. A contact for an electrical connector that has a grounding structural member; said contact comprising:

a generally cylindrical body of insulating material;

a substantially coaxial central cavity defined within and extending axially within the body, and an integral substantially tubular wall of the body enclosing the cavity;

at a first axial end of the body, a contact structure integral with or secured to the body and substantially terminating a first end of the cavity;

at a second axial end of the body opposite the first end of the body, threads defined in the body for threading into such grounding structural member of such connector;

a substantially radial first aperture defined through the tubular wall and communicating with the central cavity;

a substantially axial second aperture defined through the threaded second end of the body and communicating with the central cavity;

on an outer surface of the body, a first conductive coating forming an electrical grounding path at the outside of the body; said first conductive coating being disposed for contact with such grounding structural member when the body is threaded into such member;

on an inner surface of the wall and of the second aperture at the second end of the body, and also touching such contact structure at the first end of the body, a second conductive coating that forms an electrical-signal-carrying path along the body from the contact structure to the second aperture;

an electrical component disposed substantially axially within the cavity and having a pair of electrical leads extending axially within the cavity;

a first one of the leads further extending radially from the cavity through a generally radial aperture formed in the wall, said second conductive coating being interrupted near the first aperture to prevent contact with the first electrical lead; and a second one of the leads further extending axially from the cavity at the second axial end of the cavity that is nearer the second end of the body;

a first solder joint electrically connecting a first one of the leads to the outer first conductive coating; and a second solder joint electrically connecting a second one of the leads to the inner second conductive coating;

whereby the component lies in an electrical path between the grounding first coating and the signal-carrying second coating.

36. A contact for an electrical connector that has a grounding structural member; said contact comprising:

a generally cylindrical body of conducting material for insertion into such connector;

a substantially coaxial central cavity defined within and extending axially within the body, and a generally tubular wall of the body enclosing the cavity;

at a first axial end of the body, a first contact structure integral with or secured to the body and substantially terminating a first end of the cavity;

at a second axial end of the body opposite the first end of the body and substantially terminating a second end of the cavity, a second contact structure integral with or secured to the body for extension out of such connector; the body forming an electrical-signal-carrying path between the first and second contact structures;

a substantially radial first aperture defined through the tubular wall and communicating with the central cavity;

a substantially axial second aperture defined in the second contact structure and communicating with the central cavity;

encircling an outer surface of the body, an insulating sleeve;

encircling the insulating sleeve, a conductive band forming an electrical grounding path at the outside of the body, and disposed for contact with such grounding structural member when the body is inserted into such connnector;

an electrical component disposed substantially axially within the cavity and having a pair of electrical leads extending axially within the cavity;

a first one of the leads further extending radially from the cavity through a generally radial aperture formed in the wall, said wall aperture being significantly larger in diameter than the first one of the leads;

said first one of the leads further extending radially through a generally radial aperture formed in the sleeve and into a generally radial aperture formed in the band; said sleeve or band aperture, or both, being significantly smaller in diameter than the wall aperture to locate the first electrical lead within the wall aperture out of contact with the wall;

a second one of the leads further extending axially from the cavity into the second contact structure;

a first solder joint electrically connecting a first one of the leads to the band; and a second solder joint electrically connecting a second one of the leads to the second contact structure;

whereby the component lies in an electrical path between the grounding band and the signal-carrying body.

37. An electrical connector comprising:

a generally circumferential shell;

a structural wall of electrically conductive material spanning the shell;

a plurality of electrical-signal-conducting contacts disposed at least partly within the shell;

each contact having two ends and comprising a generally cylindrical body for conducting electrical signals from one end of the contact to another end of the contact, and a grounding path established on the outside of the body for electrical interconnection with the wall;

carried by each one of at least some of the contacts, a diode or other electrical component for bypassing selected electrical voltages to ground;

apertures formed in the wall for releasably receiving the contacts individually, and for making a grounding connection to the grounding path of each contact that carries a bypassing component;

releasable means for securing each contact in a respective one of the apertures;

said releasable securing means being fully operable to release each contact and to secure a replacement contact even after the connector is fully assembled and has been in service.

38. The connector of claim 37, wherein:

each of the contacts that carries a bypassing component has a generally coaxial central cavity, defined within and extending axially within the signal-conducting body, for receiving and enclosing the bypassing component.

39. The connector of claim 37, wherein:

each of the bodies that carries a bypassing component substantially fully encloses that component.

40. The connector of claim 37, wherein:

the releasable means comprise male threads formed in the exterior surface of each contact, and mating female threads formed within each of the apertures in the wall;

whereby each contact is threadable into or out of its respective aperture individually.

41. The connector of claim 39, wherein:

the female threads in all of the apertures are substantially identical; and all of the contacts are mechanically interchangeable;

whereby each contact is threadable into or out of any of the apertures in the wall.

42. The connector of claim 37, wherein:

the contacts carrying bypassing components are selected from a multiplicity of contact groups, the bypassing components of different groups having respective different electrical characteristics; and a contact having desired electrical characteristics is selected for each aperture.

43. The connector of claim 42, wherein:

the female threads in all of the apertures are substantially identical; and the contacts are mechanically interchangeable;

whereby each contact is threadable into or out of any of the apertures in the wall, and a contact having any of the numerous different electrical characteristics can be selected for each aperture at initial assembly or thereafter.

44. The connector of claim 37, wherein:

at least some of the contacts carry electrical filter elements;

the contacts carrying filter elements are selected from a multiplicity of contact groups, the filter elements of different groups having respective different electrical characteristics; and a contact having desired electrical characteristics is selected for each aperture.

45. The connector of claim 44, wherein:

at least some of the contacts carry both by passing components and filter elements.

46. The connector of claim 37, further comprising:

means for making a circuit ground or shield connection to said wall.

47. The connector of claim 46, wherein:

the ground-or-shield means comprise structure carried on the shell for fastening a cable shield.

48. The connector of claim 46, wherein:

the ground-or-shield means comprise one of the plurality of contacts that is a circuit-ground contact; and the circuit-ground contact is received in one of the apertures and electrically interconnects its two contact ends with the wall.

49. The connector of claim 48, wherein:

the grounding contact is mechanically interchangeable with at least some others of the plurality of contacts.

* * * * *